US012565360B2

(12) United States Patent
Bullock et al.

(10) Patent No.: US 12,565,360 B2
(45) Date of Patent: Mar. 3, 2026

(54) CONTAINER AND METHOD OF FORMING A CONTAINER

(71) Applicant: YETI Coolers, LLC, Austin, TX (US)

(72) Inventors: Dustin R. Bullock, Austin, TX (US); Daniel R. DiDomenico, Austin, TX (US); Colin Darling, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 68 days.

(21) Appl. No.: 18/166,523

(22) Filed: Feb. 9, 2023

(65) Prior Publication Data

US 2024/0270450 A1 Aug. 15, 2024

(51) Int. Cl.

| | |
|---|---|
| ***B65D 41/06*** | (2006.01) |
| ***B65D 25/28*** | (2006.01) |
| ***B65D 43/02*** | (2006.01) |
| ***B65D 47/28*** | (2006.01) |
| ***B65D 47/32*** | (2006.01) |

(Continued)

(52) U.S. Cl.

CPC ..... *B65D 43/0229* (2013.01); *B65D 25/2885* (2013.01); *B65D 47/286* (2013.01); *B65D 47/32* (2013.01); *B65D 51/18* (2013.01); *B65D 53/02* (2013.01); *B65D 81/3869* (2013.01); *B65D 2251/0025* (2013.01); *B65D 2251/0081* (2013.01); *B65D 2543/00046* (2013.01); *B65D 2543/00092* (2013.01); *B65D 2543/00518* (2013.01); *B65D 2543/00546* (2013.01); *B65D 2543/00564* (2013.01); *B65D 2543/00972* (2013.01); *B65D 2547/066* (2013.01)

(58) Field of Classification Search

CPC ..... B65D 43/0229; B65D 81/3881; B65D 41/06; B65D 2215/02; B65D 2543/00092; B65D 2543/00046; B65D 2543/00277; B65D 39/10; A47G 19/2272

USPC ..... 215/332, 222; 222/572; 220/212, 293, 220/300, 710

See application file for complete search history.

(56) References Cited

U.S. PATENT DOCUMENTS

| | | | | |
|---|---|---|---|---|
| 1,886,405 A | | 11/1932 | Knauss | |
| 3,012,686 A | * | 12/1961 | Russell | A47J 41/02 220/619 |

(Continued)

FOREIGN PATENT DOCUMENTS

| | | |
|---|---|---|
| AU | 202412944 | 9/2024 |
| AU | 202416162 | 9/2024 |

(Continued)

OTHER PUBLICATIONS

"Get MM-160-WCPR/SS 51 oz. Hammered Double Wall Copper Pitcher Item #: 375MM160WCPR MFR #: MM-160-WCPR/SS".

(Continued)

*Primary Examiner* — Charles P. Cheyney
(74) *Attorney, Agent, or Firm* — Banner & Witcoff, Ltd.

(57) ABSTRACT

An insulating container assembly can be configured to retain beverages and/or foods. The insulated container can include one of a plurality of container projections or grooves. A lid assembly can include one of a plurality of skirt grooves or projections, corresponding to the plurality of container projections or grooves of the insulated container. The lid assembly may be configured to lock in place on the container by engaging the plurality of skirt grooves or projections with the container grooves or projections when in the locked position.

15 Claims, 13 Drawing Sheets

(51) Int. Cl.

| | |
|---|---|
| ***B65D 51/18*** | (2006.01) |
| ***B65D 53/02*** | (2006.01) |
| ***B65D 81/38*** | (2006.01) |

(56) References Cited

U.S. PATENT DOCUMENTS

| | | | | |
|---|---|---|---|---|
| 3,181,951 | A | 5/1965 | Gronvold | |
| 3,451,576 | A | 6/1969 | Lewis | |
| 3,657,993 | A | 4/1972 | Close | |
| 3,721,361 | A * | 3/1973 | Barry | B65D 51/249 215/354 |
| 3,739,933 | A | 6/1973 | Degaetano | |
| 3,749,270 | A | 7/1973 | Affleck | |
| 3,776,433 | A * | 12/1973 | De Treitas | A47J 41/0027 251/215 |
| 3,844,450 | A | 10/1974 | Johnson | |
| 3,927,608 | A | 12/1975 | Doyel | |
| 4,127,211 | A | 11/1978 | Zerbey | |
| D258,795 | S | 4/1981 | Zamorski | |
| 4,373,641 | A | 2/1983 | Banich, Sr. et al. | |
| 4,434,903 | A | 3/1984 | Cooke | |
| 4,452,364 | A | 6/1984 | Kay | |
| 4,583,653 | A * | 4/1986 | Minsky | A47G 19/12 220/293 |
| D286,967 | S | 12/1986 | Appel | |
| 4,627,547 | A | 12/1986 | Cooke | |
| D291,270 | S | 8/1987 | Tardif | |
| 4,739,890 | A | 4/1988 | Cooke | |
| 5,072,850 | A * | 12/1991 | Gagnon | B65D 21/0233 220/293 |
| 5,150,803 | A | 9/1992 | Cartellone | |
| D334,869 | S | 4/1993 | Mills | |
| D350,255 | S | 9/1994 | Daenen et al. | |
| 5,407,270 | A | 4/1995 | Barile et al. | |
| 5,461,968 | A | 10/1995 | Portman | |
| 5,478,586 | A | 12/1995 | Connor | |
| 5,529,202 | A | 6/1996 | Shamis | |
| 5,544,566 | A | 8/1996 | Bersten | |
| D377,132 | S | 1/1997 | Jorgensen | |
| 5,605,244 | A | 2/1997 | Bradshaw | |
| 5,635,233 | A | 6/1997 | Levinson | |
| D383,638 | S | 9/1997 | Joergensen | |
| 5,702,020 | A * | 12/1997 | Larsen | A47G 19/2272 215/229 |
| D395,200 | S | 6/1998 | Bidwell | |
| D396,605 | S | 8/1998 | Benson | |
| 5,809,867 | A | 9/1998 | Turner et al. | |
| 5,887,510 | A | 3/1999 | Porter | |
| 5,932,098 | A | 8/1999 | Ross | |
| D416,444 | S | 11/1999 | J.o slashed.rgensen | |
| 6,079,316 | A | 6/2000 | Barden et al. | |
| 6,224,253 | B1 | 5/2001 | Dixon | |
| 6,231,909 | B1 | 5/2001 | Levinson | |
| 6,324,966 | B1 | 12/2001 | Joergensen | |
| 6,324,967 | B1 | 12/2001 | Robinson | |
| D454,275 | S | 3/2002 | Lillelund et al. | |
| 6,378,713 | B2 | 4/2002 | Montgomery | |
| 6,394,322 | B1 * | 5/2002 | Sekiya | C23C 18/28 222/572 |
| 6,422,133 | B1 | 7/2002 | Brady | |
| D476,528 | S | 7/2003 | Janky et al. | |
| 6,797,160 | B2 | 9/2004 | Huang | |
| 6,797,304 | B2 | 9/2004 | McGonagle | |
| 6,851,569 | B2 | 2/2005 | Conti et al. | |
| 6,945,014 | B1 | 9/2005 | Quann | |
| 7,040,218 | B1 | 5/2006 | Biolchini, Jr. | |
| D530,852 | S | 10/2006 | Zheng | |
| 7,165,692 | B2 | 1/2007 | Konefal et al. | |
| 7,182,213 | B2 | 2/2007 | King | |
| 7,194,951 | B1 | 3/2007 | Porter | |
| 7,198,170 | B2 | 4/2007 | Herr | |
| 7,207,465 | B2 | 4/2007 | Weist | |
| 7,213,507 | B2 | 5/2007 | Glucksman et al. | |
| D557,978 | S | 12/2007 | Bodum | |
| D562,072 | S | 2/2008 | Wahl | |
| D567,568 | S | 4/2008 | Bodum | |
| D584,559 | S | 1/2009 | Bodum | |
| D594,687 | S | 6/2009 | Bodum | |
| D595,534 | S | 7/2009 | Mankowitz | |
| 7,578,231 | B2 | 8/2009 | Liu | |
| D608,133 | S | 1/2010 | Choi | |
| D615,817 | S | 5/2010 | George | |
| D616,248 | S | 5/2010 | George | |
| D635,400 | S | 4/2011 | Snyder | |
| 7,942,287 | B2 | 5/2011 | King | |
| 8,091,724 | B2 | 1/2012 | King | |
| D656,361 | S | 3/2012 | Gilbert | |
| 8,168,243 | B1 | 5/2012 | Eaton | |
| 8,313,644 | B2 | 11/2012 | Harris et al. | |
| 8,393,487 | B1 | 3/2013 | Pillers et al. | |
| D679,949 | S | 4/2013 | Meritt | |
| D680,375 | S | 4/2013 | Pousard et al. | |
| D680,792 | S | 4/2013 | Bodum | |
| 8,517,205 | B2 | 8/2013 | Thelen | |
| 8,529,119 | B2 | 9/2013 | Swartz et al. | |
| 8,695,486 | B2 | 4/2014 | Bodum | |
| 8,863,650 | B2 | 10/2014 | Lin | |
| 8,887,623 | B2 | 11/2014 | Giordano | |
| 8,967,414 | B2 | 3/2015 | Lane | |
| 8,978,541 | B2 | 3/2015 | Lai et al. | |
| 9,010,238 | B2 | 4/2015 | Bodum | |
| D729,566 | S | 5/2015 | Morgan | |
| 9,179,798 | B2 | 11/2015 | Albanese | |
| 9,186,016 | B2 | 11/2015 | Richardson | |
| 9,192,261 | B2 | 11/2015 | Katz et al. | |
| 9,226,610 | B2 | 1/2016 | Bodum | |
| 9,232,873 | B2 | 1/2016 | Juris et al. | |
| D751,338 | S | 3/2016 | Seiders et al. | |
| D751,340 | S | 3/2016 | Seiders et al. | |
| D751,341 | S | 3/2016 | Seiders et al. | |
| 9,301,636 | B2 | 4/2016 | Varnum | |
| 9,320,383 | B2 | 4/2016 | Sands | |
| D761,619 | S | 7/2016 | Seiders et al. | |
| 9,480,279 | B2 | 11/2016 | Fogelin et al. | |
| 9,526,369 | B2 | 12/2016 | Velasquez | |
| 9,648,979 | B1 | 5/2017 | Ryan | |
| 9,661,949 | B1 | 5/2017 | Patel | |
| D797,488 | S | 9/2017 | Silsby et al. | |
| 9,801,492 | B1 | 10/2017 | Lin | |
| D802,977 | S | 11/2017 | Bodum | |
| D804,905 | S | 12/2017 | Seiders et al. | |
| D808,218 | S | 1/2018 | Seiders et al. | |
| D813,588 | S | 3/2018 | McConnell et al. | |
| D815,893 | S | 4/2018 | Seiders et al. | |
| 9,944,005 | B2 | 4/2018 | Valderrama et al. | |
| D824,212 | S | 7/2018 | Seiders et al. | |
| 10,124,942 | B2 | 11/2018 | Seiders et al. | |
| 10,232,992 | B2 | 3/2019 | Seiders et al. | |
| 10,232,993 | B2 | 3/2019 | Seiders et al. | |
| D844,382 | S | 4/2019 | Seiders et al. | |
| D844,383 | S | 4/2019 | Seiders et al. | |
| 10,258,202 | B2 | 4/2019 | Choltco-Devlin et al. | |
| 10,264,911 | B2 | 4/2019 | McLean et al. | |
| 10,285,522 | B2 * | 5/2019 | Chin | A47G 19/2272 |
| 10,301,101 | B2 | 5/2019 | Wilson | |
| 10,329,070 | B2 | 6/2019 | Wengerd | |
| 10,368,685 | B2 | 8/2019 | McLean et al. | |
| 10,370,162 | B2 | 8/2019 | Defert et al. | |
| D869,241 | S | 12/2019 | Ellison et al. | |
| D871,159 | S | 12/2019 | Ellison et al. | |
| 10,518,939 | B2 | 12/2019 | Estoque | |
| 10,564,021 | B1 | 2/2020 | Morgan | |
| D878,869 | S | 3/2020 | Kashiwada | |
| D882,343 | S | 4/2020 | Rane et al. | |
| 10,636,535 | B2 | 4/2020 | Wickland et al. | |
| D886,525 | S | 6/2020 | Seiders et al. | |
| D886,526 | S | 6/2020 | Seiders et al. | |
| D890,573 | S | 7/2020 | Jacobsen | |
| 10,729,261 | B2 | 8/2020 | Ellison et al. | |
| D899,862 | S | 10/2020 | Rane et al. | |
| D904,125 | S | 12/2020 | Jacobsen | |
| D907,956 | S | 1/2021 | Silsby | |
| 10,899,511 | B2 | 1/2021 | Showering | |
| D909,818 | S | 2/2021 | Hunter et al. | |

(56) References Cited

U.S. PATENT DOCUMENTS

| | | | | |
|---|---|---|---|---|
| D909,819 | S | 2/2021 | Ellison et al. | |
| D911,778 | S | 3/2021 | Jacobsen | |
| D911,779 | S | 3/2021 | Hunter et al. | |
| D911,780 | S | 3/2021 | Ellison et al. | |
| 10,940,981 | B2 | 3/2021 | French et al. | |
| 10,945,517 | B1 | 3/2021 | Gilbar et al. | |
| 10,973,363 | B2 | 4/2021 | Dujmich | |
| 10,988,289 | B2 | 4/2021 | Yourist et al. | |
| 11,001,422 | B2 | 5/2021 | Seiders et al. | |
| 11,014,720 | B2 | 5/2021 | Seiders et al. | |
| D922,145 | S | 6/2021 | Kuh et al. | |
| D923,411 | S | 6/2021 | McCabe et al. | |
| D923,412 | S | 6/2021 | McCabe et al. | |
| 11,021,304 | B2 | 6/2021 | Seiders et al. | |
| D926,523 | S | 8/2021 | Henkel | |
| D929,801 | S | 9/2021 | Henkel | |
| 11,109,707 | B2 | 9/2021 | Yakos | |
| D933,418 | S | 10/2021 | Sareault et al. | |
| D933,427 | S | 10/2021 | Ellison et al. | |
| D933,428 | S | 10/2021 | Ellison et al. | |
| D934,633 | S | 11/2021 | Hunter et al. | |
| D935,278 | S | 11/2021 | Hunter et al. | |
| D939,281 | S | 12/2021 | Kim et al. | |
| D939,889 | S | 1/2022 | Ni | |
| D960,647 | S | 8/2022 | Yang | |
| 11,447,309 | B2 | 9/2022 | Jinkins et al. | |
| 2001/0022304 | A1 | 9/2001 | Roche | |
| 2001/0030205 | A1 | 10/2001 | Nybakke | |
| 2002/0088810 | A1* | 7/2002 | Murakami | B65D 81/3881 220/739 |
| 2003/0047081 | A1 | 3/2003 | McGonagle | |
| 2003/0200822 | A1 | 10/2003 | Layton | |
| 2005/0011894 | A1 | 1/2005 | Eberle | |
| 2005/0109774 | A1 | 5/2005 | Orioles | |
| 2005/0127076 | A1* | 6/2005 | Law | A47G 19/2272 220/254.1 |
| 2006/0213912 | A1 | 9/2006 | Zaytoun | |
| 2006/0236870 | A1 | 10/2006 | Tardif | |
| 2007/0028779 | A1 | 2/2007 | Pigliacampo et al. | |
| 2007/0137495 | A1 | 6/2007 | Talbert | |
| 2007/0151461 | A1 | 7/2007 | Edmark et al. | |
| 2007/0278202 | A1 | 12/2007 | Long et al. | |
| 2008/0245237 | A1 | 10/2008 | Haverstock | |
| 2008/0257849 | A1 | 10/2008 | Farrar et al. | |
| 2008/0305226 | A1 | 12/2008 | Catena et al. | |
| 2009/0188884 | A1 | 7/2009 | Nelson et al. | |
| 2009/0263550 | A1 | 10/2009 | Navarini et al. | |
| 2010/0192780 | A1 | 8/2010 | Bodum | |
| 2010/0319549 | A1 | 12/2010 | Kelty et al. | |
| 2011/0056948 | A1 | 3/2011 | Brennan | |
| 2011/0083560 | A1 | 4/2011 | Chen | |
| 2013/0248537 | A1 | 9/2013 | Lane | |
| 2013/0284030 | A1 | 10/2013 | Katz et al. | |
| 2014/0072684 | A1 | 3/2014 | Madden | |
| 2015/0122828 | A1 | 5/2015 | Madala | |
| 2015/0272378 | A1 | 10/2015 | Sands | |
| 2016/0037960 | A1 | 2/2016 | McLean et al. | |
| 2016/0255989 | A1 | 9/2016 | Beber et al. | |
| 2016/0262564 | A1 | 9/2016 | Scott et al. | |
| 2017/0000285 | A1 | 1/2017 | Martija et al. | |
| 2017/0000289 | A1 | 1/2017 | Feber | |
| 2017/0027350 | A1 | 2/2017 | Onza et al. | |
| 2017/0181567 | A1 | 6/2017 | Martija et al. | |
| 2017/0295987 | A1 | 10/2017 | Habram | |
| 2017/0325617 | A1 | 11/2017 | Dujmich | |
| 2018/0110357 | A1 | 4/2018 | Eisenberg | |
| 2018/0242765 | A1* | 8/2018 | Rane | A47G 23/0266 |
| 2018/0303269 | A1 | 10/2018 | Yakos | |
| 2019/0059412 | A1 | 2/2019 | Jacobs | |
| 2019/0290048 | A1 | 9/2019 | Albanese | |
| 2019/0350401 | A1 | 11/2019 | Zimmermann | |
| 2019/0357721 | A1 | 11/2019 | Herndon | |
| 2019/0365136 | A1 | 12/2019 | Farkas | |
| 2020/0015619 | A1 | 1/2020 | Chimezie | |
| 2020/0029723 | A1 | 1/2020 | Patel | |
| 2020/0113369 | A1 | 4/2020 | Bardot et al. | |
| 2020/0121116 | A1 | 4/2020 | Forsberg et al. | |
| 2020/0329891 | A1 | 10/2020 | Ellison et al. | |
| 2020/0361672 | A1 | 11/2020 | Jinkins et al. | |
| 2021/0009303 | A1 | 1/2021 | Kim | |
| 2021/0085121 | A1 | 3/2021 | Liang et al. | |
| 2021/0085123 | A1 | 3/2021 | Shi et al. | |
| 2021/0107705 | A1 | 4/2021 | Lipshy et al. | |
| 2021/0307554 | A1 | 10/2021 | Zhao | |
| 2021/0378428 | A1 | 12/2021 | Jinkins et al. | |
| 2021/0378437 | A1 | 12/2021 | Morse | |
| 2022/0009700 | A1 | 1/2022 | Khem | |
| 2022/0135314 | A1* | 5/2022 | Ke | B65D 81/3841 220/739 |

FOREIGN PATENT DOCUMENTS

| | | | |
|---|---|---|---|
| BR | 302019001304-0001 | | 9/2019 |
| BR | 302019001305-0001 | | 9/2019 |
| CA | 157230 | S | 8/1914 |
| CA | 46604 | S | 2/1980 |
| CA | 53464 | S | 10/1984 |
| CA | 169338 | S | 2/2017 |
| CA | 185908 | S | 11/2020 |
| CA | 185907 | S | 4/2021 |
| CN | 3024951 | | 5/1994 |
| CN | 2461422 | Y | 11/2001 |
| CN | 3606899 | | 2/2007 |
| CN | 300959563 | | 7/2009 |
| CN | 302264331 | S | 1/2013 |
| CN | 302770904 | | 3/2014 |
| CN | 204033119 | U | 12/2014 |
| CN | 303220122 | S | 5/2015 |
| CN | 303326301 | S | 8/2015 |
| CN | 204743779 | U | 11/2015 |
| CN | 303475221 | S | 12/2015 |
| CN | 303487928 | S | 12/2015 |
| CN | 303602391 | S | 3/2016 |
| CN | 303686220 | S | 5/2016 |
| CN | 303688943 | S | 6/2016 |
| CN | 303689058 | S | 6/2016 |
| CN | 106108648 | A | 11/2016 |
| CN | 303984393 | | 12/2016 |
| CN | 304100941 | S | 4/2017 |
| CN | 106714627 | A | 5/2017 |
| CN | 304230993 | S | 8/2017 |
| CN | 304267174 | S | 9/2017 |
| CN | 304312013 | S | 10/2017 |
| CN | 304362318 | S | 11/2017 |
| CN | 206750487 | U | 12/2017 |
| CN | 304418757 | S | 12/2017 |
| CN | 206950063 | U | 2/2018 |
| CN | 304508350 | S | 2/2018 |
| CN | 107960864 | A | 4/2018 |
| CN | 304570122 | S | 4/2018 |
| CN | 108245021 | A | 7/2018 |
| CN | 108338684 | A | 7/2018 |
| CN | 304745435 | | 7/2018 |
| CN | 208030840 | U | 11/2018 |
| CN | 208426734 | U | 1/2019 |
| CN | 305007325 | S | 1/2019 |
| CN | 305069179 | S | 3/2019 |
| CN | 305230085 | S | 6/2019 |
| CN | 305514112 | S | 12/2019 |
| CN | 209932418 | U | 1/2020 |
| CN | 305607132 | S | 2/2020 |
| CN | 305622724 | S | 2/2020 |
| CN | 305622735 | S | 2/2020 |
| CN | 305622880 | S | 2/2020 |
| CN | 305762391 | S | 5/2020 |
| CN | 305783509 | S | 5/2020 |
| CN | 305798262 | | 5/2020 |
| CN | 305798262 | S | 5/2020 |
| CN | 305832835 | S | 6/2020 |
| CN | 305841244 | S | 6/2020 |
| CN | 305857388 | S | 6/2020 |
| CN | 305916013 | S | 7/2020 |
| CN | 305969448 | S | 8/2020 |
| CN | 305969449 | S | 8/2020 |

(56) References Cited

FOREIGN PATENT DOCUMENTS

| | | | |
|---|---|---|---|
| CN | 306001550 | S | 8/2020 |
| CN | 306110687 | S | 10/2020 |
| CN | 306116015 | S | 10/2020 |
| CN | 306116018 | S | 10/2020 |
| CN | 306124520 | S | 10/2020 |
| CN | 111907906 | A | 11/2020 |
| CN | 306165021 | S | 11/2020 |
| CN | 306179836 | S | 11/2020 |
| CN | 306194955 | S | 11/2020 |
| CN | 306214126 | | 12/2020 |
| CN | 306221309 | S | 12/2020 |
| CN | 306240063 | S | 12/2020 |
| CN | 213009737 | U | 4/2021 |
| CN | 213075407 | U | 4/2021 |
| CN | 306448208 | S | 4/2021 |
| CN | 306766575 | | 8/2021 |
| CN | 306766575 | S | 8/2021 |
| CN | 306807521 | | 9/2021 |
| CN | 306807521 | S | 9/2021 |
| CN | 306860435 | | 10/2021 |
| CN | 306860435 | S | 10/2021 |
| CN | 306889289 | | 10/2021 |
| CN | 306889289 | S | 10/2021 |
| CN | 214856049 | U | 11/2021 |
| CN | 306938059 | S | 11/2021 |
| CN | 306954257 | | 11/2021 |
| CN | 306954329 | S | 11/2021 |
| CN | 306960910 | S | 11/2021 |
| CN | 306989074 | | 12/2021 |
| CN | 306989074 | S | 12/2021 |
| CN | 306989173 | | 12/2021 |
| CN | 215383226 | U | 1/2022 |
| CN | 215686825 | U | 2/2022 |
| CN | 215708687 | U | 2/2022 |
| CN | 307111479 | S | 2/2022 |
| CN | 307123398 | S | 2/2022 |
| CN | 215993651 | U | 3/2022 |
| CN | 307165859 | S | 3/2022 |
| CN | 307314799 | S | 5/2022 |
| CN | 307489359 | | 8/2022 |
| DE | 7505675 | U | 3/1976 |
| DE | 404039980001 | S | 1/2005 |
| DE | 102017120822 | A1 | 3/2019 |
| EM | 000105655-0015 | | 3/2004 |
| EM | 000675764-0001 | | 1/2009 |
| EM | 0011077910004 | S | 1/2009 |
| EM | 001107791-0004 | | 4/2009 |
| EM | 0012726600004 | S | 4/2011 |
| EM | 001272660-0004 | | 5/2011 |
| EM | 0019018100001 | S | 8/2011 |
| EM | 004359800-0001 | | 10/2017 |
| EM | 006156113-0001 | | 4/2019 |
| EM | 006156113-0002 | | 4/2019 |
| EM | 006156113-0003 | | 4/2019 |
| EM | 006156113-0004 | | 4/2019 |
| EM | 006156113-0005 | | 4/2019 |
| EM | 006156113-0006 | | 4/2019 |
| EM | 006354742-0001 | | 10/2020 |
| EM | 006354742-0002 | | 10/2020 |
| EP | 0831031 | A2 | 3/1998 |
| EP | 0895942 | A1 | 2/1999 |
| EP | 1099399 | A1 | 5/2001 |
| EP | 1267684 | B1 | 5/2006 |
| EP | 2705781 | A1 | 3/2014 |
| EP | 2798985 | A1 | 11/2014 |
| EP | 2858913 | A1 | 4/2015 |
| EP | 2858913 | B1 | 4/2015 |
| EP | 3200659 | B1 | 12/2019 |
| EP | 3639707 | A1 | 4/2020 |
| FI | M197500850001 | S | 3/1977 |
| FR | 115727001 | S1 | 8/1975 |
| FR | 123333001 | S1 | 11/1977 |
| FR | 2938172 | A1 | 5/2010 |
| GB | 240951 | A | 4/1925 |
| GB | 267447 | A | 3/1927 |
| GB | 327215 | A | 4/1930 |
| GB | 468161 | A | 6/1937 |
| GB | 476406 | A | 12/1937 |
| GB | 476641 | A | 12/1937 |
| GB | 488813 | A | 7/1938 |
| GB | 602441 | A | 5/1948 |
| GB | 694495 | A | 7/1953 |
| GB | 831801 | A | 3/1960 |
| GB | 848835 | A | 9/1960 |
| GB | 1015294 | A | 12/1965 |
| GB | 2190073 | A | 11/1987 |
| GB | 2378639 | A | 2/2003 |
| GB | 2417232 | B | 2/2006 |
| GB | 3024951 | | 7/2006 |
| GB | 2504684 | A | 2/2014 |
| GB | 2534543 | A | 8/2016 |
| GB | 6052501 | S | 1/2019 |
| GB | 9006156113-0001 | | 2/2019 |
| GB | 9006156113-0002 | | 2/2019 |
| GB | 9006156113-0003 | | 2/2019 |
| GB | 9006156113-0004 | | 2/2019 |
| GB | 9006156113-0005 | | 2/2019 |
| GB | 9006156113-0006 | | 2/2019 |
| GB | 9006354742-0001 | | 3/2019 |
| GB | 9006354742-0002 | | 3/2019 |
| GB | 6127789 | | 3/2021 |
| GB | 6131759 | | 4/2021 |
| GB | 6256067 | | 1/2023 |
| IL | 46604 | | 9/2010 |
| IN | 314399-001-0001 | | 2/2020 |
| IN | 314443-001-0001 | | 12/2020 |
| JP | 57043255 | U1 | 3/1982 |
| JP | 2003054598 | A | 2/2003 |
| JP | D1190857 | S | 10/2003 |
| JP | D1190857 | | 11/2003 |
| JP | D1219538 | | 10/2004 |
| JP | D1288694 | | 12/2006 |
| JP | D1389300 | S | 4/2010 |
| JP | D1404145 | S | 11/2010 |
| JP | 2015144696 | A | 8/2015 |
| JP | D1541678 | S | 1/2016 |
| JP | 6087614 | B2 | 3/2017 |
| JP | 2018192035 | A | 12/2018 |
| JP | 2019111111 | A | 7/2019 |
| JP | 1654103 | S | 2/2020 |
| JP | D1660587 | | 6/2020 |
| JP | D1660587 | S | 6/2020 |
| JP | 2022030827 | A | 2/2022 |
| JP | 3236697 | U | 3/2022 |
| JP | D1709061 | S | 3/2022 |
| JP | D1709062 | S | 3/2022 |
| JP | 1725481 | S | 9/2022 |
| KR | 200306270 | Y1 | 3/2003 |
| KR | 100807949 | B1 | 2/2008 |
| KR | 1020140083465 | A | 7/2014 |
| KR | 300920131 | | 8/2017 |
| KR | 30-0956050 | S | 5/2018 |
| KR | 301108636.0000 | | 5/2021 |
| KR | 20210084252 | A | 7/2021 |
| KR | 20210115658 | A | 9/2021 |
| NO | 317418 | B1 | 10/2004 |
| NZ | 540040 | A | 11/2006 |
| TR | 201505052001 | S | 7/2015 |
| TR | 201707626002 | S | 11/2017 |
| TR | 201707626-0002 | | 12/2017 |
| TW | M446591 | U | 2/2013 |
| TW | M538766 | U | 4/2017 |
| TW | M553973 | U | 1/2018 |
| WO | 1997011626 | A1 | 4/1997 |
| WO | 2002067739 | A1 | 9/2002 |
| WO | 03062720 | A2 | 7/2003 |
| WO | 2007101355 | A1 | 9/2007 |
| WO | 2008028308 | A1 | 3/2008 |
| WO | 08044948 | A1 | 4/2008 |
| WO | 2009149568 | A2 | 12/2009 |
| WO | 2010003258 | A1 | 1/2010 |
| WO | 2010031198 | A2 | 3/2010 |
| WO | 2011014972 | A1 | 2/2011 |
| WO | 2012025125 | A2 | 3/2012 |

(56) References Cited

FOREIGN PATENT DOCUMENTS

| | | | |
|---|---|---|---|
| WO | D094255-001 | | 1/2017 |
| WO | 2018071495 | A1 | 4/2018 |
| WO | 2018111119 | A1 | 6/2018 |
| WO | 2018140483 | A1 | 8/2018 |
| WO | 2019001675 | A1 | 1/2019 |
| WO | 2019110441 | A1 | 6/2019 |
| WO | 2019144193 | A1 | 8/2019 |
| WO | 2021226603 | A1 | 11/2021 |

OTHER PUBLICATIONS

Walco HX622 Vanguard 68 oz. Stainless Steel Pitcher, https://webstaurantstore.com/walco-hx622-680oz-vanguard-stainless-steel-pitcher, visited Aug. 19, 2021.
84-Ounce Sweat-Free Beverage Pitcher, Stainless Steel, Vacuum Insulated, https:www.walmart.com/ip/84-Ounce-Sweat-Free-Beverage-Pitcher-Stainless-Steel-Vacuum-Insulated/651735673.
StenLock All Stainless Steel Water Jug Bottle Ice Water Wide Inlet Lid 1.5 L, https://www.ebay.com/itm/353103328138.
JVR Stainless Steel Water Pitcher with Lid | 1.6-L / 57-oz Thermal Carafe for Water, Coffee, Juice, Ice Tea, Lemonade, Sangria & Milk | BPA-Free, Premium Stainless Steel Pitcher with Handle | Lime.
Skinny Tumblers with Handle—Our New Design Size: 20/30oz, https://www.pinterest.com/pin/585679126526969712/.
MANYHY 12oz Stainless Steel Coffee Mug with Handle and Sliding Lid, Insulated Travel Cup, Double Wall Vacuum Thermal Thermos Camping Tumbler for Hot & Cold Tea Drinks (Light Green, 1 Pack): Kitchen & Dining.
Travel Mug—RTIC Travel Mugs—Stainless Steel, Insulated and Reusable, https://rticoutdoors.com/Travel-Mugs?name=Travel-Mug&size=20oz&color=Graphite&material=Matte&utm_source=google&utm_medium=cpc&utm.
Coffee Mug 16oz Vacuum Insulated Camping Mug with Lid, https://buymorecoffee.com/shop/coffee-mug-16oz-vacuum0insulated-camping-mug-with-lid.
The 9 Best Insulated Tumblers of 2021, https://www.tripsavvy.com/best-insulated-tumbers-4844260.
Yeti, "The New Rambler French Press," May 9, 2024, DealTown, https://deal.town/yeti/the-new-rambler-french-press-FKYXMQES2 (Year: 2024).
Wbcooksey, "French Press," May 17, 2024, Reddit, www.reddit.com/r/YetiCoolers/comments/1cu4020/french_press/ (Year: 2024).
84 Ounce Sweat Free Beverage Pitcher, published date unknown but prior to Jul. 5, 2022, retrieved from https://www.walmart.com/ip/84-Ounce-Sweat-Free-Beverage-Pitcher-Stainless-Steel-Vacuum-Insulated/651735673 on Jul. 5, 2022.
Walco HX622 Vanguard 68 oz. Stainless Steel Pitcher, published date unknown but prior to Jul. 5, 2022, retrieved from https://www.webstaurantstore.com/walco-hx622-68-oz-vanguard-stainless-steel-pitcher/935HX622.html on Jul. 5, 2022.
Get MM-160-WCPR/SS 51 oz. Hammered Double Wall Copper Pitcher, published date unknown but prior to Jul. 5, 2022, retrieved from https://www.webstaurantstore.com/get-mm-160-wcpr-ss-51-oz-hammered-double-wall-copper-pitcher/375MM160WCPR.html on Jul. 5, 2022.
StenLock All Stainless Steel Water Jug Bottle Ice Water Wide Inlet Lid, published date unknown but prior to Jul. 7, 2022, retrieved from https://www.ebay.com/itm/353103328138 on Jul. 7, 2022.
JVR Stainless Steel Water Pitcher with Lid, published date unkown but prior to Jul. 7, 2022, retrieved from https://www.walmart.com/ip/JVR-Stainless-Steel-Water-Pitcher-Lid-1-6-L-57-oz-Thermal-Carafe-Water-Coffee-Juice-Ice-Tea-Lemonade-Sangria-Milk-BPA-Free-Premium-Handle-Lime/618570047 on Jul. 7, 2022.
Skinny Tumblers with Handle, published date unkown but prior to Jul. 7, 2022, retrieved from https://www.pinterest.com/pin/585679126526969712/ on Jul. 7, 2022.
MANYHY 12oz Stainless Steel Coffee Mug with Handle and Sliding Lid, published date unkown but prior to Jul. 7, 2022, retrieved from https://supplyleader.com/product/MANYHY-12oz-Stainless-Steel-Coffee-Mug-with-Handle-and-Sliding-Lid-Insulated-Travel-Cup-Double-Wall-Vacuum-Thermal-Thermos-Camping-Tumbler-for-Hot-amp-Cold-Tea-Drinks-Light-Green-1-Pack/B08BL37SZM on Jul. 7, 2022.
RTIC Travel Mug, published date unkown but prior to Jul. 7, 2022, retrieved from https://rticoutdoors.com/Travel-Mug on Jul. 7, 2022.
Coffee Mug 16oz Vacuum Insulated Camping Mug with Lid, published date unkown but prior to Jul. 7, 2022, retrieved from https://buymorecoffee.com/shop/coffee-mug-16oz-vacuum-insulated-camping-mug-with-lid/ on Jul. 7, 2022.
RTIC Double Wall Vacuum Insulated 12oz Coffee Cup, published date Mar. 19, 19, retrieved from https://www.amazon.com.au/RTIC-Insulated-Travel-Coffee-Stainless/dp/B07NJZDPGZ on Jul. 8, 2022.
YETI Boomer 4 Dog Bowl, retrieved on Jun. 2, 2022, https://www.yeti.com/dogs/dog-bowls/21071501086.html, 8 pgs.
YETI Rambler 10 oz Stackable Mug, retrieved on Jun. 2, 2022, https://www.yeti.com/drinkware/mugs/21071501046.html, 9 pgs.
YETI Rambler 14 oz Mug, retrieved on Jun. 2, 2002, https://www.yeti.com/drinkware/mugs/21071500972.html, 8 pgs.
YETI Rambler 24 oz Mug, retrieved on Jun. 2, 2022, https://www.yeti.com/drinkware/mugs/21071501010.html, 9 pgs.
YETI Rambler 20 oz Tumbler, retrieved on Jun. 2, 2002, https://www.yeti.com/drinkware/tumblers/21071500958.html, 8 pgs.
YETI Rambler 30 oz Tumbler, retrieved on Jun. 2, 2022, https://www.yeti.com/drinkware/tumblers/21071501033.html, 9 pgs.
YETI Rambler Magslider Lid, retrieved on Jun. 2, 2022, https://www.yeti.com/drinkware/accessories/21070070011.html, 7 pgs.
May 10, 2024—(WO) International Search Report & Written Opinion—PCT/US2024/012956.
Feb. 17, 2025—(WO) International Search Report and Written Opinion—PCT/SE24/055435.
https://www.amazon.com/Congela-stainless-insulated-camping-tumbler/dp/B08RDCV2H6/ref=sr_1_4?keywords=insulated%2Bmug%20&qid=1656454511%20&s=home-garden&sr=1-4&th=1.
https://www.amazon.com/Culver-18-Ounce-Campfire-Ceramic-White/dp/B07CNVWPKK/ref=sr_1_fkmr0%20%201?keywords=Culver+18-%20Ounce+Tail+Campfire+Ceramic+%20Mug+Set+of+4+%28White%29%3A+Kitchen+%26+Dining&qid=1578077705&sr=8-1-fkmr0%20Culver%20Apr.%202018.
KeepCup-Inside Business, 1 color page, published on Feb. 14, 2012, https://www.youtube.com/watch?v=hJ5xUpC8VXQ.
https://www.amazon.com/SUNWILL-Insulated-Stainless-Reusable-Pearlized/dp/B0972YGQHW/ref=psdc_284507_t3_B07ZGMX2MS?th=1.
www.amazon.com/YETI-Rambler-Stainless-Vacuum-Insulated/dp/B0773SN3GX/ref=.
www.amazon.com/Hot-Cold-Double-Stainless-Insulated/dp/B07BRQRC6K/ref=.
https://www.amazon.com/YETI-Rambler-Stainless-Vacuum-Insulated/dp/B07FPWVVTN/ref=sr_1_2?dchild+=1&keywords=yeti%2Bmug+&qid=1601304329&sr=8-2&th=1&psc=1.
https://www.amazon.com/Townie-Insulated-Coffee-Double-Vacuum/dp/B07BB31PJ7/ref=sr_1_1?keywords=+Maars+%2BDrinkware%2B+79716-1PK%2B14%2Boz%2B%7C%2BDouble%2BWall%2BVacuum%2BSealed%2BTumbler%2BTravel%2BFriendly%2C%2BCompact%2BSize%2C%2B1%2BPack%2C%2BMatcha%2BGreen%3A%2BHome%2B%26%2BKitchen&qid=1578083307&sr=8-1&th=1.
https://www.amazon.com/American-Mug-Pottery-Ceramic-Square/dp/B06XRVLR72/ref=sr_1_1?keywords=American%20+Mug+Pottery+Ceramic+Square+Handle+Coffee+Mug%2C+Made+in+USA%2C+Cobalt+%20Blue%2C+17+oz+-+Pack%20+of+2%3A+Coffee+Cups+%%2026+Mugs&qid=1578083413&sr=8-1.
https://www.amazon.com/Stainless-Vacuum-Insulated-Travel-Handle/dp/B07G9C1TZ6/ref=.
https://www.amazon.com/dp/B07G369PK4/ref=.
"Congela 22oz 2Pack Stainless Steel Insulate Coffee Mug With Thick Handle"; Amazon.com; retrieved Jun. 28, 2022; published date unknown; URL: <https://www.amazon.com/Congela-stainless-insulated-camping-tumbler/dp/B08RDCV2H6/ref=sr_1_4?keywords=insulated%2Bmug%20&qid=1656454511%20&s=home-garden&sr=1-4&th=1>.

(56) References Cited

OTHER PUBLICATIONS

"Culver 18-Ounce Tall Campfire Ceramic Mug Set of 4"; Amazon.com; retrieved Dec. 31, 2019; published date unknown; URL: <https://www.amazon.com/Culver-18-Ounce-Campfire-Ceramic-White/dp/B07CNVWPKK/ref=sr_1_fkmr0%20%201?keywords=Culver+18-%20Ounce+Tail+Campfire+Ceramic+%20Mug+Set+of+4+%28White%29%3A+Kitchen+%26+Dining&qid=1578077705&sr=8-1-fkmr0%20Culver%20Apr.%202018>.
"KeepCup—Inside Business"; youtube.com; retrieved Oct. 8, 2024; published Feb. 14, 2012; URL: <https://www.youtube.com/watch?v=hJ5xUpC8VXQ>.
"SUNWILL Insulated Coffee Mug with Handle"; Amazon.com; retrieved Jun. 28, 2022; published date unknown; URL: <https://www.amazon.com/SUNWILL-Insulated-Stainless-Reusable-Pearlized/dp/B0972YGQHW/ref=psdc_284507_t3_B07ZGMX2MS?th=1>.
Oct. 25, 2019, JP Office Action-App. No. 2019-002063.
Jun. 24, 2020 (JP) OA-App. No. 2019-002063.
"YETI Rambler 14oz Stainless Steel Vacuum Insulated Mug with Lid"; Amazon.com; retrieved Oct. 2, 2018; published date unknown; URL: <www.amazon.com/YETI-Rambler-Stainless-Vacuum-Insulated/dp/B0773SN3GX/ref=>.
"Hot or Cold—12oz. Double Wall Stainless Steel, Copper Vacuum Insulated "; Amazon. com; retrieved Oct. 2, 2018; published date unknown; URL: <www.amazon.com/Hot-Cold-Double-Stainless-Insulated/dp/B07BRQRC6K/ref=>.
"YETI Rambler 14oz Stainless Steel Vacuum Insulated Mug with Lid"; Amazon.com; retrieved Oct. 2, 2018; published date unknown; URL: <https://www.amazon.com/YETI-Rambler-Stainless-Vacuum-Insulated/dp/B07FPWVVTN/ref=sr_1_2?dchild+=1&keywords=yeti%2Bmug+&qid=1601304329&sr=8-2&th=1&psc=1>.
"Maars Drinkware 79716-1PK 14oz."; Amazon.com; retrieved Dec. 31, 2019; published date unknown; URL: <https://www.amazon.com/Townie-Insulated-Coffee-Double-Vacuum/dp/B07BB31PJ7/ref=sr_1_1?keywords=+Maars+%2BDrinkware%2B+79716-1PK%2B14%2Boz%2B%7C%2BDouble%2BWall%2BVacuum%2BSealed%2BTumbler%2BTravel%2BFriendly%2C%2BCompact%2BSize%2C%2B1%2BPack%2C%2BMatcha%2BGreen%3A%2BHome%2B%26%2BKitchen&qid=1578083307&sr=8-1&th=1>.
"American Mug Pottery Ceramic Square Handle Coffee Mug"; Amazon.com; retrieved Dec. 31, 2019; published date unknown; URL: <https://www.amazon.com/American-Mug-Pottery-Ceramic-Square/dp/B06XRVLR72/ref=sr_1_1?keywords=American%20+Mug+Pottery+Ceramic+Square+Handle+Coffee+Mug%2C+Made+in+USA%2C+Cobalt+%20Blue%2C+17+oz+-+Pack%20+of+2%3A+Coffee+Cups+%%2026+Mugs&qid=1578083413&sr=8-1>.
"Insulated Coffee Mug with Lid and Handle"; Amazon.com; retrieved Oct. 2, 2018; published date unknown; URL: <https://www.amazon.com/Stainless-Vacuum-Insulated-Travel-Handle/dp/B07G9C1TZ6/ref=>.
"Coffee Mug—Stainless Steel Double Wall Insulated Tumbler with Lids"; Amazon.com; retrieved Oct. 2, 2018; published date unknown; URL: <https://www.amazon.com/dp/B07G369PK4/ref=>.
Jul. 3, 2024—(AU) Formalities Notice No. 1—App. No. 202412944.
Jul. 3, 2024—(AU) Formalities Notice No. 1—App. No. 202412948.
Jul. 3, 2024—(AU) Formalities Notice No. 1—App. No. 202412954.
Jun. 11, 2024—(NZ) First Office Action—App. No. 433688.
Jun. 11, 2024v(NZ) First Examination Report—App. No. 433691.
"Bodum Travel Press, Stainless Steel Travel Coffee and Tea Press"; amazon.com; retrieved Feb. 10, 2023; published Aug. 10, 2012; URL: <https://www.amazon.com/Bodum-Travel-Press-Stainless-Coffee/dp/B008TYX1DW>.
"ESPRO P1 Travel Coffee Press"; espro.com; retrieved Feb. 10, 2023; published date unknown; URL: <https://www.espro.com/products/coffee-travel-press-p1?variant=40619355701427>.
"Stanley the Travel Mug French Press"; amazon.com; retrieved Feb. 10, 2023; published Oct. 29, 2018; URL: <https://www. amazon.com/Stanley-Classic-Travel-French-Press/dp/B07L6N6JC4>.
"ESPRO P6 French French Double Walled"; amazon.com; retrieved Feb. 10, 2023; published Oct. 1, 2019; URL: <https://www.amazon.com/ESPRO-2132C2-French-Press-Brushed/dp/B011WTWFZK>.
"Primula Lexington French Press Coffee Tea Maker Insulated Stainless Steel"; amazon.com; retrieved Feb. 10, 2023; published Mar. 1, 2020; URL: <https://www.amazon.com/dp/B0858WF2TC/ref=sbl_dpx_dining-french-presses_B011WTWFZK>.
"Simpli Press French Press Coffee & Tea Maker"; amazon.com; retrieved Feb. 10, 2023; published Sep. 19, 2017; URL: <https://www.amazon.com/Simpli-Press-Coffee-Red/dp/B075RGTX4Z>.
"BruTrek Double Shot 3.0 Travel Coffee French Press"; amazon.com; retrieved Feb. 10, 2023; published Mar. 30, 2021; URL: <https://www.amazon.com/BruTrek-Insulated-Stainless-Storage-Brewing/dp/B08VSBDJDJ>.
"casaWare Stainless Steel 32-Ounce Thermal French Press"; amazon.com; retrieved Feb. 10, 2023; published Aug. 27, 2019; URL: <https://www.amazon.com/dp/B07X2VWWB5/ref=sbl_dpx_dining-french-presses_B07VJ4RXZ4>.
"Clara French Press"; fellowproducts.com; retrieved Feb. 10, 2023; published date unknown; URL: <https://fellowproducts.com/products/clara-french-press>.
"French Press Travel Mug with Handle"; jonesfamilytravels.com; retrieved Feb. 10, 2023; published date uknown; URL: <https://jonesfamilytravels.com/product/french-press-travel-mug-with-handle-storage-container-for-extra-coffee-and-2-spill-proof-lids-14-oz-silver>.
"GSI Outdoors Glacier Vacuum Java Press"; rei.com; retrieved Feb. 10, 2023; published date unknown; URL: <https://www.rei.com/product/194195/gsi-outdoors-glacier-vacuum-java-press-33-fl-oz>.
"Original Design Small U French Press"; amazon.com; retrieved Feb. 10, 2023; published Aug. 26, 2020; URL: <https://www.amazon.sa/-/en/Original-Design-Resistant-Barista-Milliliter/dp/B07XNNT84P>.
"Thermos FN548 34 oz. Stainless Steel Vacuum Insulated Coffee Press"; webrestaurantstore.com; retrieved Feb. 10, 2023; published date unknown; URL: < https://www.webstaurantstore.com/thermos-fn548-34-oz-stainless-steel-vacuum-insulated-coffee-press/826FN548.html>.
"widesea Camping Coffee Pot 750ml with French Press Coffee Maker"; amazon.com; retrieved Feb. 10, 2023; published Jul. 19, 2019; URL: <https://www.amazon.com/WIDESEA-Camping-Coffee-750ML-French/dp/B07VJ4RXZ4?th=1>.
Walmart.com, "Rubbermaid Classic 1 Gallon Pitcher, 3-Position Lid, Easy Pour Red Lid", Rubbermaid, retrieved on Sep. 24, 2025 from <https://www.walmart.com/ip/Rubbermaid-Classic-1-Gal-Pitcher/16408617,>, 4 pgs.
Stelton.com, "EM77 Vacuum Jug 33.8 oz", Stelton, retrieved on Sep. 24, 2025 from <https://www.stelton.us/products/em77-vacuum-jug-33-8-oz,> 5 pgs.
Alfi.De, "Hotello Insulated Carafe 0.60L", Alfi, retrieved on Sep. 24, 2025 from <https://alfi.de/en/products/insulated-carafes-teapots/hotello-insulated-carafe-0-60-I,> 3 pgs.
Swell.com, "Carafe with Lid", S'well, retrieved on Sep. 24, 2025 from <https://www.swell.com/products/carafe-with-lid,> 11 pgs.
Alfi.De, "Eco Insulated Carafe 1.00L", Alfi, retrieved on Sep. 24, 2025 from <https://alfi.de/en/products/insulated-carafes-teapots/eco-insulated-carafe-1-00-I,> 4 pgs.
Stanley1913.com, "Classic Stay Chill Beer Pitcher 64 oz", Stanley, retrieved on Sep. 24, 2025 from <https://www.stanley1913.com/products/classic-stay-chill-pitcher-64-oz,> 7 pgs.
Hastingscollective.com, "Venera Thermal Carafe 68 oz Black", Hastings Collective, retrieved on Sep. 24, 2025 from <https://www.hastingscollective.com/products/copy-of-gray-venera-thermal-carafe-68-oz,> 2 pgs.
Sep. 26, 2025—(NZ) Examination Report No. 1—App. No. 823999.
Dec. 17, 2025—(EP) Examination Report—App. No. 24709906.2.

* cited by examiner

CONTAINER AND METHOD OF FORMING A CONTAINER

FIELD

The present disclosure herein relates broadly to containers, and more specifically to rigid insulated containers used for beverages or foods.

BACKGROUND

A container may be configured to store food and/or a volume of liquid. Containers may be composed of rigid materials, such as a metal. These containers can be formed of a double-wall vacuum-formed construction to provide insulative properties to help maintain the temperature of the food or beverage within the container.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

In certain examples, an insulating container assembly can be configured to retain beverages and/or foods. The insulated container assembly can include an insulated container and a lid assembly. The insulated container may include an outer shell having an external sidewall and an outer bottom wall, an inner shell having an inner sidewall and an inner bottom wall. The outer shell can be connected to the inner shell to form an insulated double wall structure with a sealed vacuum cavity between the outer shell and the inner shell. The insulated container can include a top opening at a top of the inner sidewall that leads into a storage cavity formed by the inner sidewall and the inner bottom wall, and the top opening can include a container pour spout. The insulated container can include one of a plurality of container projections or grooves.

The lid assembly can include a lid assembly pour spout corresponding to the container pour spout, a top surface comprising a top surface channel for receiving a slider, an opening adjacent the lid assembly pour spout. The slider can be configured to move from an opened position to a closed position to cover the opening. The lid assembly can include a skirt extending axially from the rim. And the skirt may include one of a plurality of skirt grooves or projections, corresponding to the plurality of container grooves or projections of the insulated container. The lid assembly may be configured to lock in place on the container by engaging the plurality of skirt grooves or projections with the container grooves or projections when in the locked position.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different components of various examples: however, the disclosed examples are not limited to that particular scale.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. Also, while the terms "top," "bottom," "front," "side," "rear," and the like may be used in this specification to describe various example features and elements of the examples, these terms are used herein as a matter of convenience, e.g., based on the example orientations shown in the figures or the orientation during typical use. Nothing in this specification should be construed as requiring a specific three-dimensional orientation of structures in order to fall within the scope of this disclosure.

Aspects of this disclosure relate to a lid assembly 100 and an insulating container 200. FIGS. 1-11 depict a lid assembly 100 and FIGS. 12-21 depict an insulating container 200. The insulating container 200 may function as a container or pitcher for liquids, beverages, ice, foods, etc. In the example lid assembly 100 of FIGS. 1-11, the lid assembly 100 can be configured to be secured to the container 200, such that the lid assembly 100 does not easily come off of the container 200 during use of the container 200. The example lid assembly 100 can be configured to be removably fastened to the container 200 by a series of grooves 120*a*, 120*b*, 120*c*, and 120*d* located on the lid assembly 100 where the grooves 120*a*, 120*b*, 120*c*, and 120*d* are configured to align with projections 220*a*, 220*b*, 220*c*, and 220*d* located on the container 200. As such, the user can align the lid assembly 200 grooves 120*a*, 120*b*, 120*c*, and 120*d* with the projections 220*a*, 220*b*, 220*c*, and 220*d* on the container 200 and twist the lid assembly 200 to lock the lid assembly 200 into place onto the container 200.

Figure 1:
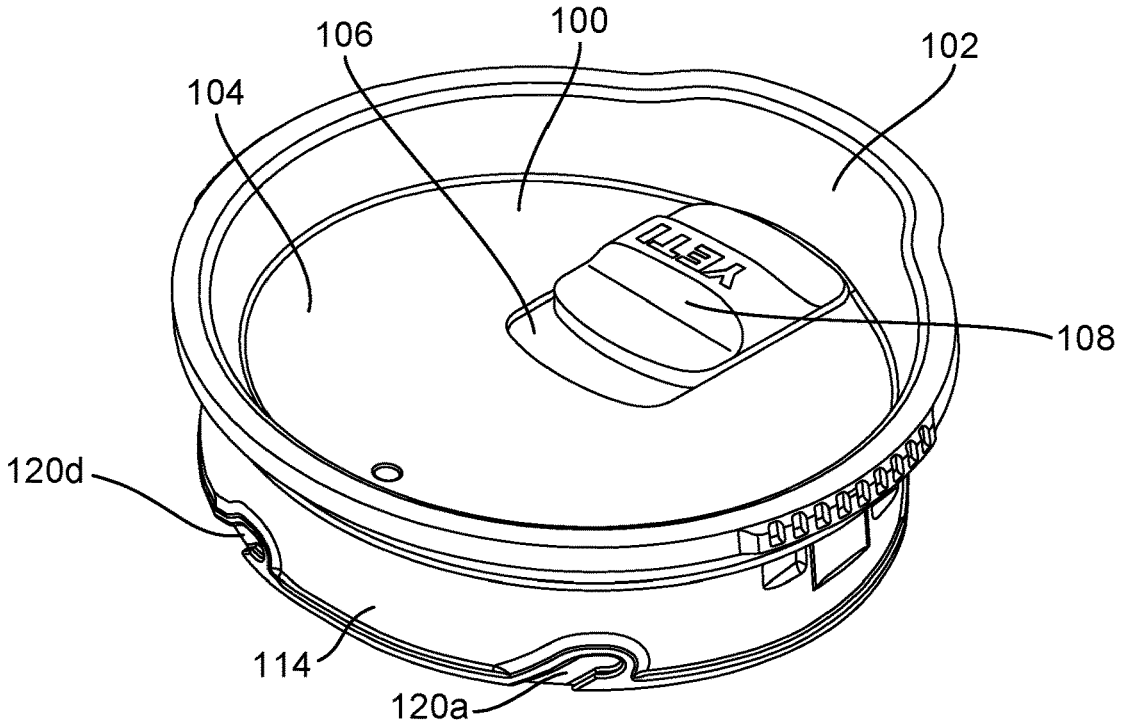
FIG. 1 depicts a right perspective view of an example lid assembly.
Figure 2:
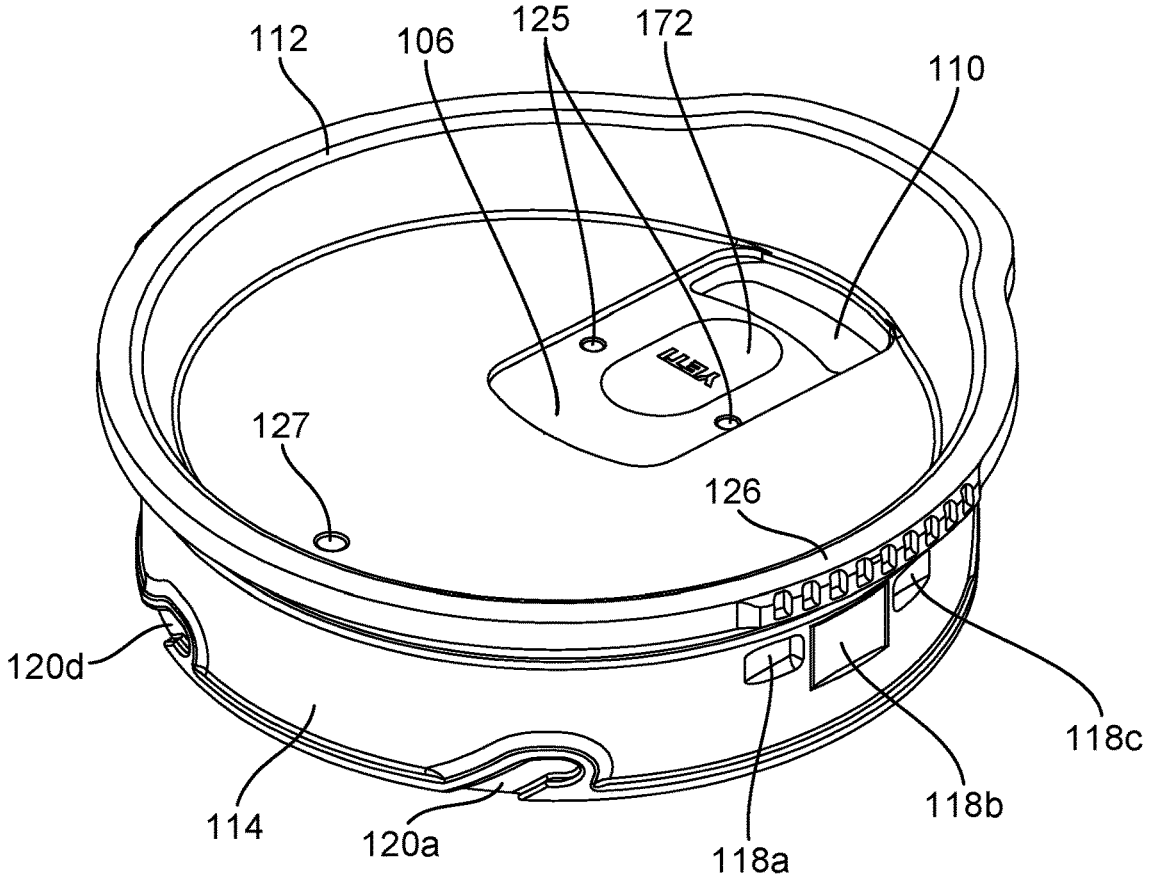
FIG. 2 depicts a right perspective view of a partial assembly of the example lid assembly of FIG. 1.
Figure 7:
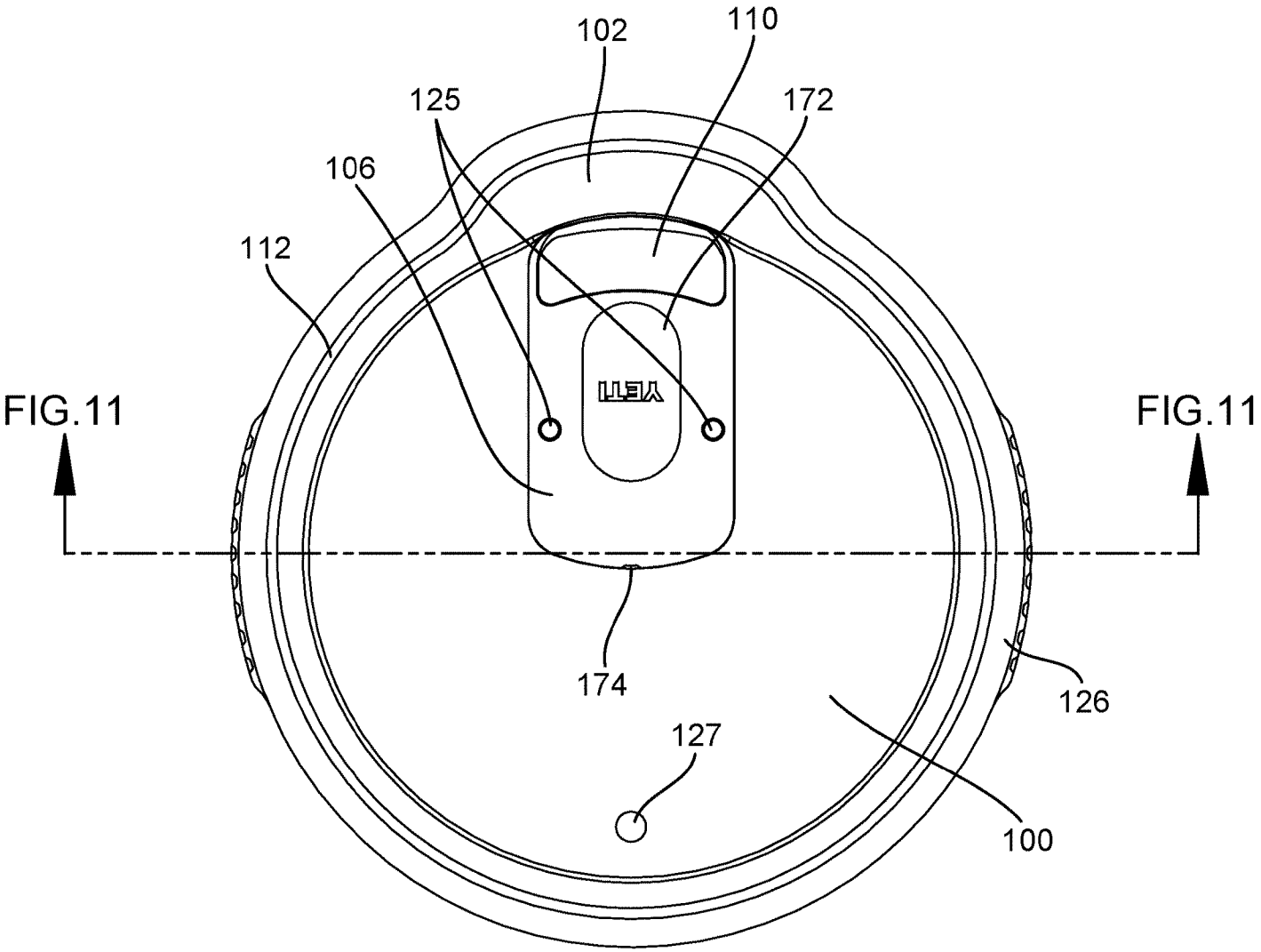
FIG. 7 depicts a top view of a partial assembly of the example lid assembly of FIG. 1.
Figure 9:
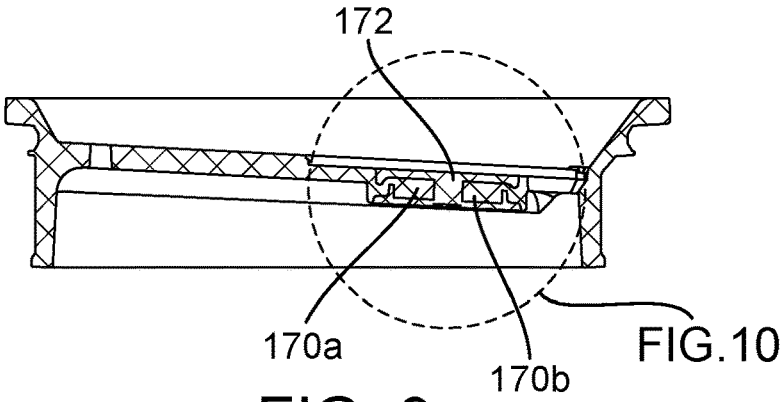
FIG. 9 shows a cross-sectional view along line 9-9 in FIG. 4.

Turning specifically to the lid assembly 100, in one example, as shown in FIGS. 1, 2, and 7, the lid assembly 100 can include a lid assembly pour spout 102, which corresponds in shape and size to a container pour spout 202 discussed below. The lid assembly 100 can also include a top surface 104 positioned at an angle toward the lid assembly pour spout 102 to provide for ease of pouring the contents from the insulated container 200, as shown in FIG. 9. The top surface 104 may include a top surface channel 106 for receiving a slider 108 as shown in FIG. 1. The top surface channel 106 may also include an opening 110 adjacent the lid assembly pour spout 102 for the dispensing of the contents of the container 200 as shown in FIG. 2. The channel 106 may also include a pair of vents 125 to displace the air within the container 200 while liquid is dispensed through the opening 110. Additionally vent 127 can be provided on the top surface 104 of the lid assembly 100 opposite the opening 110. The lid assembly 100 may also include a rim 112, which is configured to extend above a rim 212 of the container 200 when assembled to the container 200. The slider 108 is configured to move from an opened position for the user to access the contents of the container, for example by pouring and to a closed position to cover the opening in order to prevent the contents of the container from spilling.

As shown in FIGS. 2-6, the lid assembly 100 may also include a skirt 114 that extends axially from the rim 112. The skirt 114 can include a radially extending channel 128 about a top portion of the skirt 114, and a gasket 130 can be positioned in the radially extending channel 128. Additionally, in this example, the skirt 114 may include a plurality of skirt grooves 120*a*, 120*b*, 120*c*, and 120*d*, which correspond to a plurality of container projections 220*a*, 220*b*, 220*c*, and 220*d* located on the insulated container 200. In this example, as discussed herein, the lid assembly 100 is configured to lock in place on the container by engaging the plurality of skirt grooves 120*a*, 120*b*, 120*c*, 120*d* with the container projections 220*a*, 220*b*, 220*c*, 220*d* when in the locked position. The lid assembly 100 may include gripping elements 126 for the user to rotate the lid assembly relative to the insulated container 200 in order to secure the lid assembly 100 to the insulated container 200 or to remove the lid assembly 100 from the insulated container 200. As shown for example in FIG. 2, the skirt 114 may include a series of optional molding channels or notches 118*a*, 118*b*, 118*c*. These optional channels or notches can be implemented to constrain the flow of resin used to form the lid to provide better moldability.

In other examples, it is contemplated that the skirt 114 or another portion of the lid assembly 100 could include a plurality of projections and the container could include a plurality of grooves which correspond to and receive the projections located on the skirt 114 or other portion of the lid assembly 100. Also, although four grooves and projections are used in this example, it is contemplated that more or fewer grooves and projections could be used without departing from this disclosure.

Figure 3:
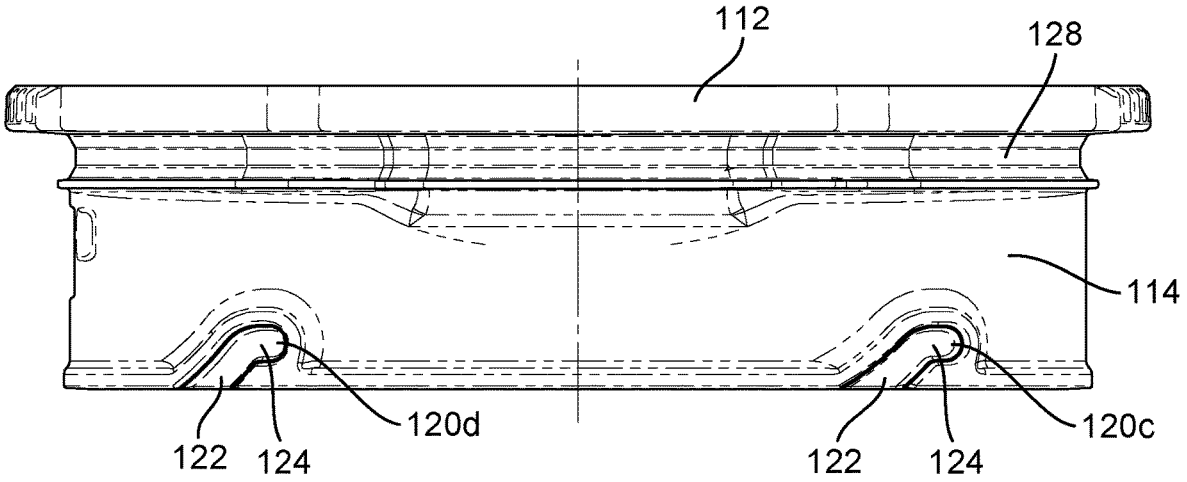
FIG. 3 depicts a front view of a partial assembly of the example lid assembly of FIG. 1.
Figure 4:
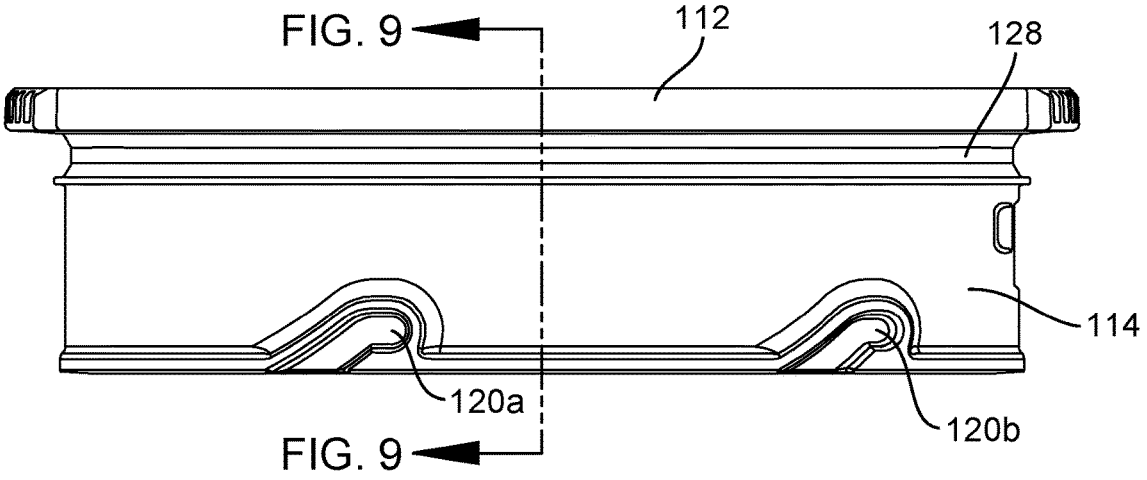
FIG. 4 depicts a front view of a partial assembly of the example lid assembly of FIG. 1.
Figure 17:
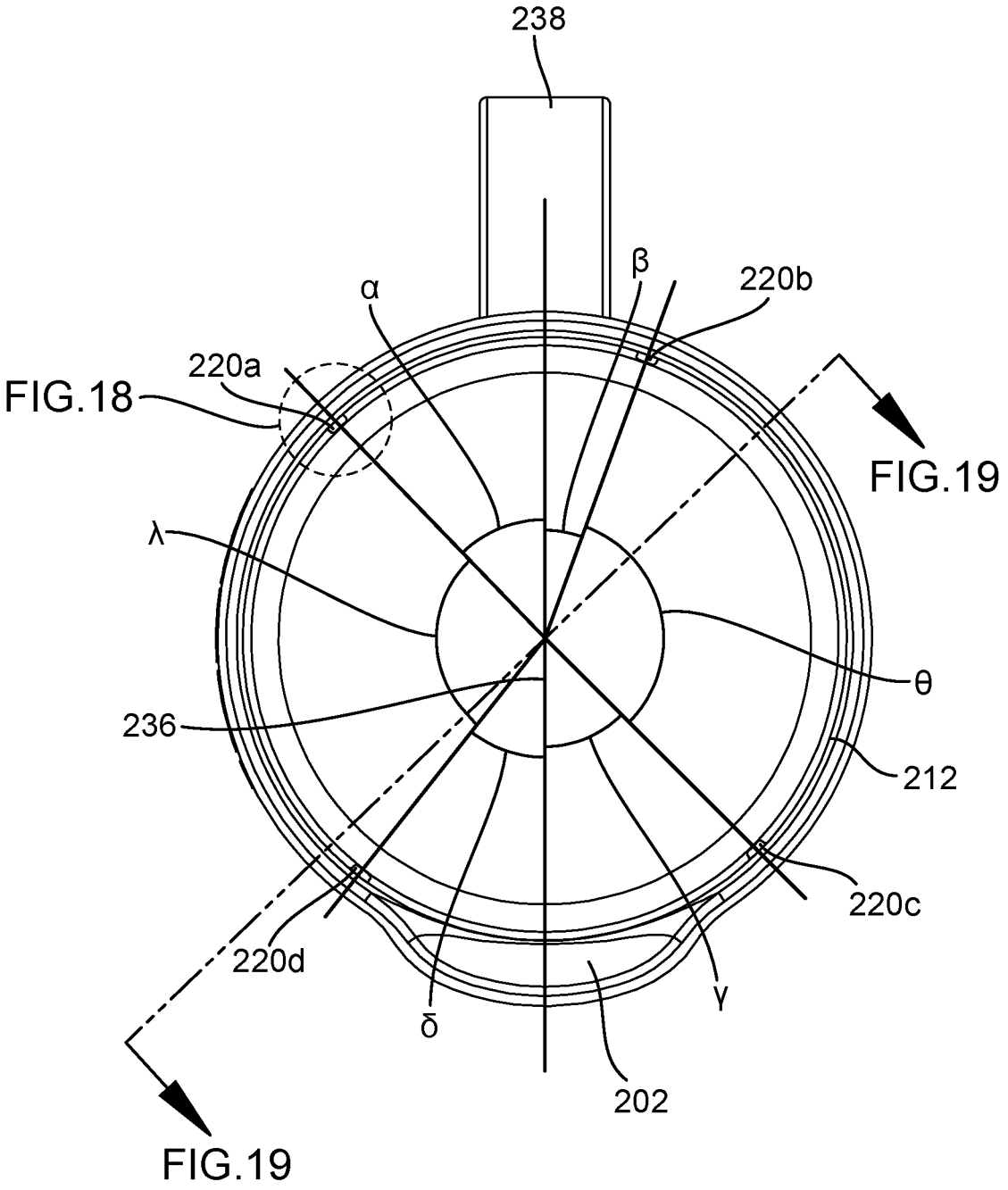
FIG. 17 shows a top view of the container of FIG. 12.

As is shown in FIGS. 1-6, and the plurality of skirt grooves 120*a*, 120*b*, 120*c*, 120*d* can be positioned below the gasket 130. Also the plurality of skirt grooves 120*a*, 120*b*, 120*c*, 120*d* extend in a radial direction and an axial direction. As shown in FIGS. 3, the plurality of skirt grooves can each have a first straight portion 122 extending in a radial and axial direction and a second straight portion 124 extending only in a radial direction on the lid assembly skirt 114. In one example, the first straight portion 122 may be oriented about 45 degrees relative to a spout central axis 236 as shown in FIG. 17 when the lid assembly 100 is assembled to the insulated container 200. In this example, the first straight portion 122 can be longer than the second straight portion 124. Also the second straight portion 124 can be generally parallel to the rim 212 of the insulated container 200 when assembled. In this example, the first straight portion and the second straight portion may extend for a total of about between 10 to 180 degrees in the radial direction and in one example, the first straight portion and the second straight portion may extend for a total of about between 10 to 30 degrees in the radial direction. So in this example, the user can rotate the lid assembly 100 between an eighth and a half rotation to lock the lid assembly to the container 200 in order to secure the lid assembly 100 to the container 200. In this example, the plurality of grooves 120*a*, 120*b*, 120*c*, and 120*d* may extend to a certain depth in the sidewall forming the skirt 114 corresponding to the depth of the plurality of projections 220*a*, 220*b*, 220*c*, and 220*d* in the container. In other examples, the plurality of grooves 120*a*, 120*b*, 120*c*, and 120*d* may extend entirely through the sidewall forming the skirt 114.

Figure 8:
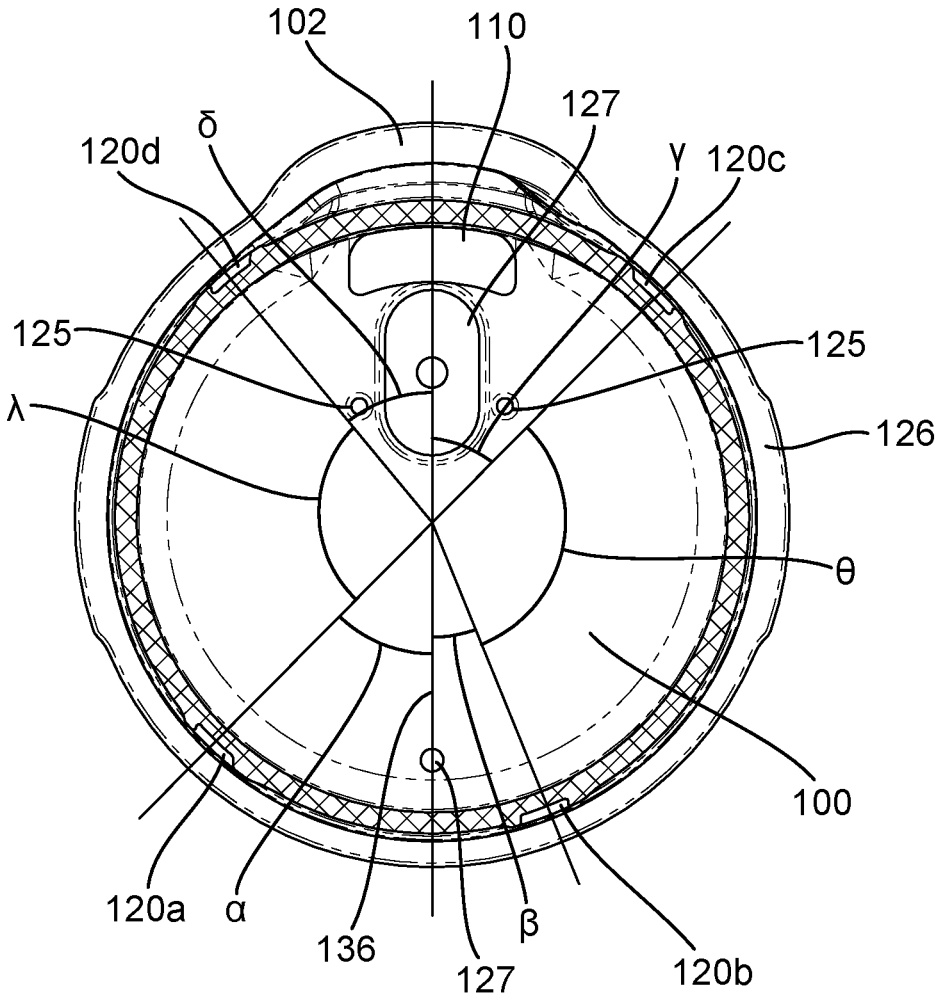
FIG. 8 depicts a bottom view of the example lid assembly of FIG. 1.

In this example, as is shown in FIG. 8, which is a bottom view of the lid assembly 100, the plurality of skirt grooves 120*a*, 120*b*, 120*c*, 120*d* are positioned about the lid assembly asymmetrically about the circumference of the lid assembly 100. And as such, the plurality of skirt grooves 120*a*, 120*b*, 120*c*, and 120*d* can be positioned about the lid asymmetrically in the radial direction, meaning that each of the plurality of skirt grooves 120*a*, 120*b*, 120*c*, and 120*d* can be positioned at different radial dimensions relative to each other or at a different amount of degrees relative to each other. Also, in this example, as is shown in FIGS. 1-6, the plurality of skirt grooves 120*a*, 120*b*, 120*c*, 120*d* can be positioned at the same distance or depth relative to the rim 112 in the axial direction. In this example, the lid assembly 100 can be configured to be placed onto the container 200 in a single orientation due to the asymmetrical plurality of insulated container projections 220*a*, 220*b*, 220*c*, 220*d* and the asymmetrical plurality of skirt grooves 120*a*, 120*b*, 120*c*, and 120*d*. Additionally, the lid assembly 100 can be configured to be placed onto the container 200 in a single orientation due to the corresponding shapes of the lid assembly spout 102 and the container spout 202.

In this example, with reference to FIG. 8, which is bottom view of the lid assembly 100, the lid assembly spout 102 may define a spout central axis 136. A first one 120*a* of the plurality of skirt grooves may be positioned at a first angle $\alpha$ relative to the lid assembly spout central axis 136. Also a second one 120*b* of the plurality of skirt grooves can be positioned at a second angle $\beta$ relative to the lid assembly spout central axis 136. The first angle $\alpha$ can be greater than the second angle $\beta$.

In this example, a third one 120*c* of the plurality of skirt grooves can be positioned at a third angle $\gamma$ relative to the spout central axis 136. Also a fourth one 120*d* of the plurality of skirt grooves may be positioned at a fourth angle $\delta$ relative to the spout central axis 136. In this example, the fourth angle δ is smaller than the third angle γ. In addition, the fourth angle δ is smaller than the first angle α. In one particular example, the first angle α can be about 44 degrees, the second angle β can be about 20 degrees, the third angle γ can be about 45 degrees, the fourth angle δ can be about 38 degrees. As such, the plurality of skirt grooves 120*a*, 120*b*, 120*c*, 120*d* can each positioned at a different angle relative to an adjacent one of the plurality of skirt grooves 120*a*, 120*b*, 120*c*, 120*d*, and each of the first angle α, the second angle β, the third angle γ, and the fourth angle δ can be acute and less than 90 degrees.

Also the sum of the first angle α and the second angle β can be about 64 degrees to form an acute angle between the first one 120*a* and the second one 120*b* of the plurality of skirt grooves. Also the sum of the third angle γ and the fourth angle δ can be about 83 degrees to form an acute angle between the third one 120*c* and the fourth one 120*d* of the plurality of skirt grooves.

Additionally, a fifth angle θ can be formed between the second one 120*b* of the plurality of skirt grooves and the third one 120*c* of the plurality of skirt grooves, and a sixth angle λ can be formed between the fourth skirt groove 120*d* and the first skirt groove 120*a*.

The fifth angle θ can be about 115 degrees, and the sixth angle λ can be about 98 degrees. As such, the fifth angle θ and the sixth angle λ can both be obtuse and greater than 90 degrees. Accordingly, the fifth angle θ between the second one 120*b* of the plurality of skirt grooves and the third one 120*c* of the plurality of skirt grooves can be obtuse. And the sixth angle λ between the first one 120*a* of the plurality of skirt grooves and the forth one 120*d* of the plurality of skirt grooves can be obtuse.

In alternative examples, it is contemplated that the plurality of skirt grooves 120*a*, 120*b*, 120*c*, 120*d* can be substituted with projections. And in another example, the plurality of skirt grooves 120*a*, 120*b*, 120*c*, 120*d* can be a combination of grooves and projections. Moreover, it is contemplated that the plurality of skirt grooves 120*a*, 120*b*, 120*c*, and 120*d* can be positioned symmetrically in the radial direction. Also, in other examples, it is contemplated that the plurality of skirt grooves 120*a*, 120*b*, 120*c*, and 120*d* can be positioned at different distances or depths relative to the rim 112 in the axial direction, and the corresponding plurality of container projections 220*a*, 220*b*, 220*c*, and 220*d* be correspondingly positioned to align with the plurality of skirt projections 120*a*, 120*b*, 120*c*, and 120*d* when positioning the lid assembly 100 in the locked position. It is also contemplated that the lid assembly can include one or more biasing members or springs for positioning, further securing, or locking the lid assembly skirt grooves 120*a*, 120*b*, 120*c*, and 120*d* in position on the container projections 220*a*, 220*b*, 220*c*, and 220*d*.

Figure 5:
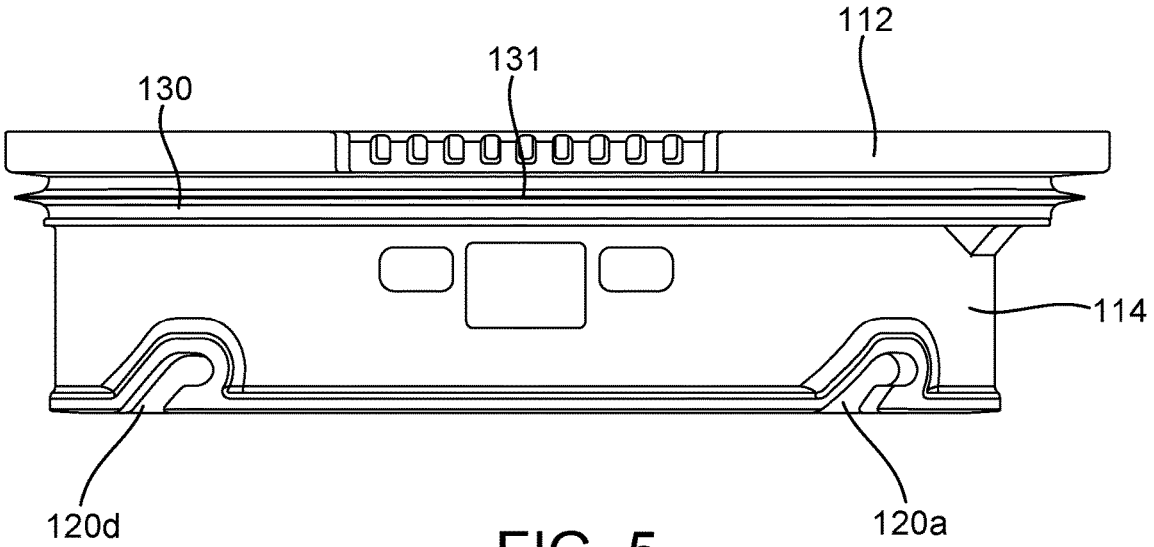
FIG. 5 depicts a right-side view of the example lid assembly of FIG. 1.
Figure 6:
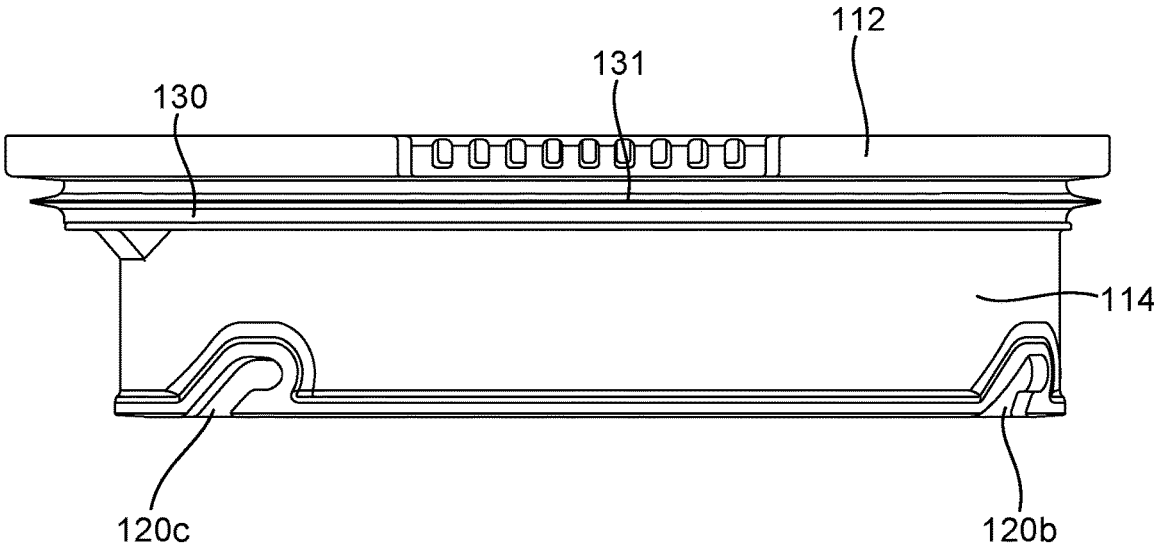
FIG. 6 depicts a left-side view of the example lid assembly of FIG. 1.

Referring to FIGS. 5, 6, the gasket 130 can be positioned just below the rim 112 and can have a single blade 131. In other examples, the gasket can be a face seal gasket, a corner seal gasket, or have a c-shaped cross-section. In certain examples, the lid assembly install torque can be at or between 1 ft*lb and 8 ft*lb and in one specific example, the lid assembly install torque can be at or between 2 and 3 ft*lb and in particular about 2.6 ft*lb. Also in certain examples the lid uninstall torque can be between 0.5 ft*lb and 4.5 ft*lb and in one specific example the uninstall torque can be between 0.5 ft*lb and 2.0 ft*lb and in particular about 1.5 ft*lb.

In one example, the lid assembly 100 can include a movable slider 108, which may include a tab or handle 109 for the user to grasp in order to move the slider 108 into an opened or closed position. The slider 108 of the lid assembly 100 in one example, can be a magnetic slider. In certain examples, the slider 108 can be configured to perform one or more of the following: (1) slide between a closed position where the slider covers an opening to aid in preventing spilling of contents of the container and an opened position where the slider 108 uncovers the opening 110 such that the contents of the container can be consumed, (2) lock in place in both the closed position and the opened position, (3) remain secured to the lid assembly 100 during movement between the closed position and the opened position, or (4) to be removable from the lid assembly 100 so that the lid assembly 100 and slider 108 can be cleaned. The slider 108 and lid assembly 100 can be similar to that described in U.S. patent application Ser. No. 14/971,779 filed on Dec. 16, 2015, now U.S. Pat. No. 10,232,992, which is fully incorporated by reference.

Figure 10:
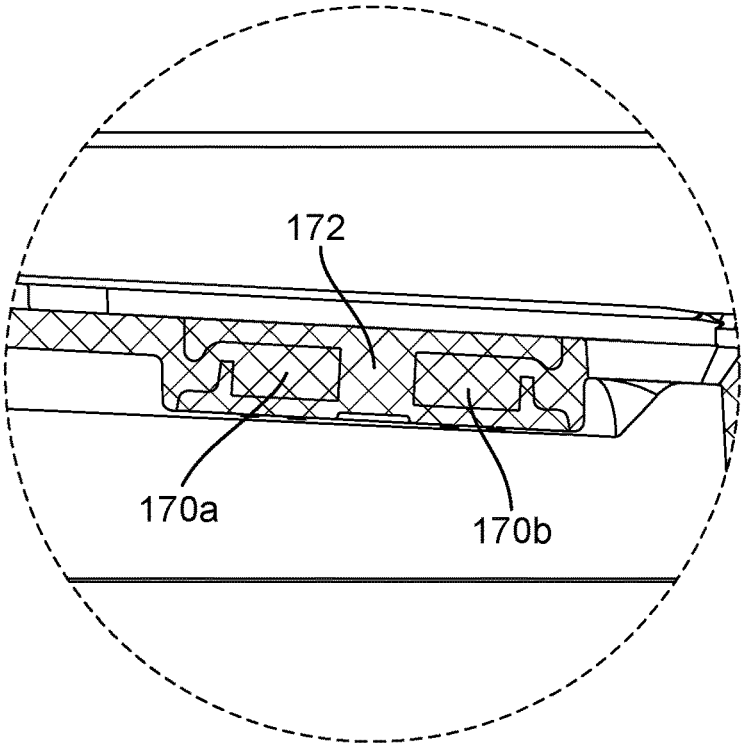
FIG. 10 shows an enlarged section of the cross-sectional view of FIG. 9.

As shown in FIGS. 9 and 10, the lid assembly 100 can be provided with two magnets, which can be disc magnets 170A, 170B. The slider 108 can also be provided with a disc magnet which is not shown. The disc magnet located in the slider 108 can be a first clamping and positioning magnet, and the disc magnets 170A, 170B are second and third clamping and positioning magnets 170A, 170B within the lid assembly 100. In this example, the magnets can maintain the slider 108 onto the lid assembly 100, and maintain the slider 108 in either the open or closed positions during the use of the slider 108. For instance, the first clamping and positioning magnet in the slider interacts with the second clamping and positioning magnet 170A to maintain the lid assembly 100 in the opened position: whereas the first clamping and positioning magnet in the slider interacts with the third clamping and positioning magnet 170B to maintain the lid assembly 100 in the closed position.

Figure 11:
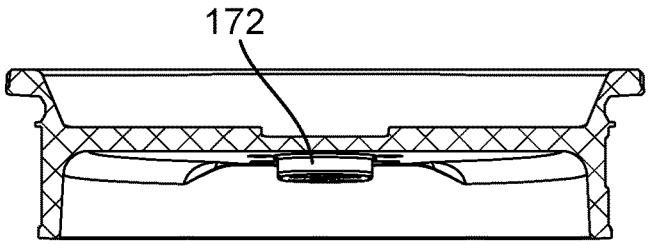
FIG. 11 shows a cross-sectional view along line 11-11 in FIG. 7.

FIGS. 9, 10, and 11 show cross-sectional views of the lid assembly 100 without the slider 108. As shown in FIGS. 9, 10, and 11, a magnet shroud 172 can be positioned in the top of the lid assembly 100. The magnet shroud 172 may include the second clamping and positioning magnet 170A and the third clamping and positioning magnet 170B, where the second clamping and positioning magnet 170A and the third clamping and positioning magnet 170B can be encased within the magnet shroud 172. In one example, the magnet shroud 172 can be molded into the lid assembly 100 as an integral assembly.

Also as shown in FIG. 7, the lid assembly 110 may also include a slight nub 174 within the channel 106. The nub 174 can be located on a rear wall of the channel 106. The nub 174 provides a stop for the slider 108, such that the slider 108 engages the nub 174 when in the fully opened position. In this way, a gap can be formed between the slider 108 and the rear wall of the channel 106 and when any liquid is located in the channel 106, the gap can help to prevent displacement of liquid within the channel 106. This, in turn, helps to prevent the slider movement to the opened position from splashing the user with the liquid located in the channel 106 to provide a better user experience. In addition, the slider 108 can be provided with tapered ends, which also creates spacing between the slider 108 and the channel, thus, reducing the amount of splashing of any contents located in the channel 106 of the lid assembly 100. This may help especially near the opening of the lid, where due to the angle of the channel 106, liquid tends to travel down the slope of the channel 106 and collect near the opening 110 in the lid assembly 100. In this way, when the user closes the lid assembly 100 with the slider 108, the splashing of the contents near the opening of the lid assembly 100 is reduced.

It is also contemplated that the slider does not include magnets and relies on one or more detents, projections, channels to maintain the slider in an opened or closed position such as those described in U.S. patent application Ser. No. 14/971,779 filed on Dec. 16, 2015, now U.S. Pat. No. 10,232,992, which is fully incorporated by reference above.

Turning now to the insulated container 200, as shown in FIGS. 12-21, the insulated container 200 can include an outer shell 230 having an external sidewall 230A and an outer bottom wall 230B. The insulated container 200 can also include an inner shell 232 having an inner sidewall 232A and an inner bottom wall 232B. The outer shell 230 can be connected to the inner shell 232 forming an insulated double wall structure with a sealed vacuum cavity between the outer shell 230 and the inner shell 232. The insulated container 200 can have a top opening 234 at a top of the inner sidewall 232A that leads into a storage cavity 240 formed by the inner sidewall 232A and the inner bottom wall 232B. The top opening 234 may also include a container pour spout 202. While the illustrated example has a generally cylindrical shape, the shape of the container 200 may be any shape such as a rectangular cuboid, or other desired three-dimensional shape that could hold fluids, beverages, or other food items.

Figure 12:
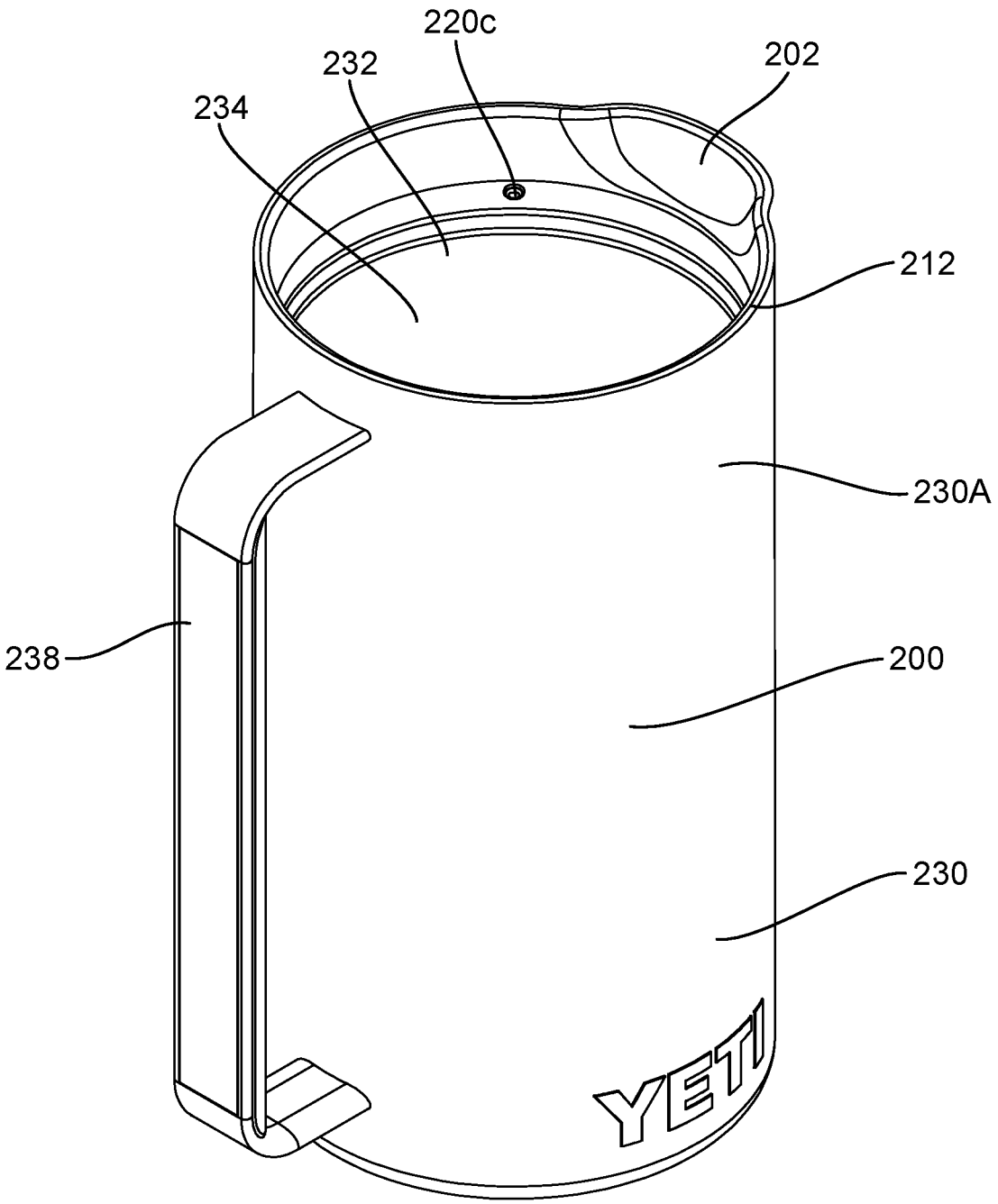
FIG. 12 shows a right perspective view of a container.
Figure 14:
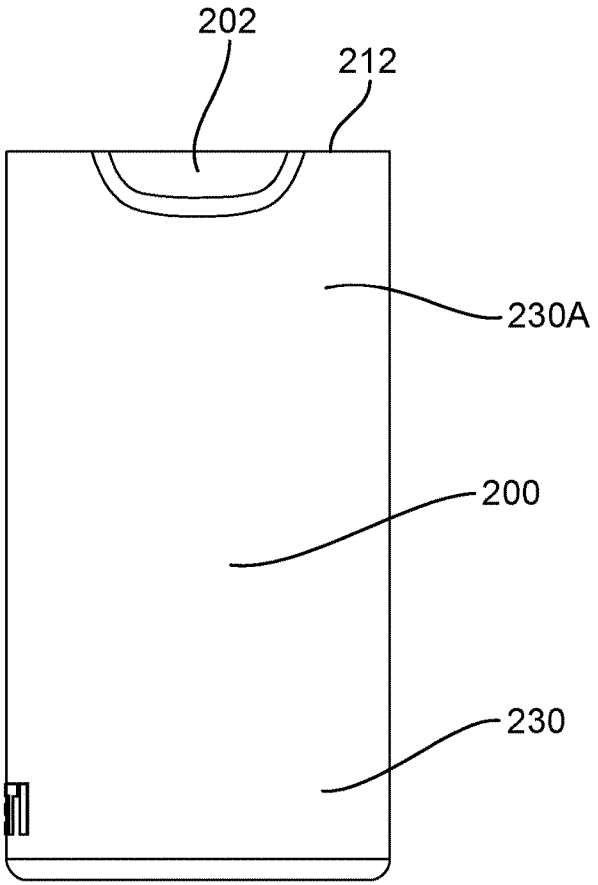
FIG. 14 shows a front view of the container of FIG. 11.
Figure 13:
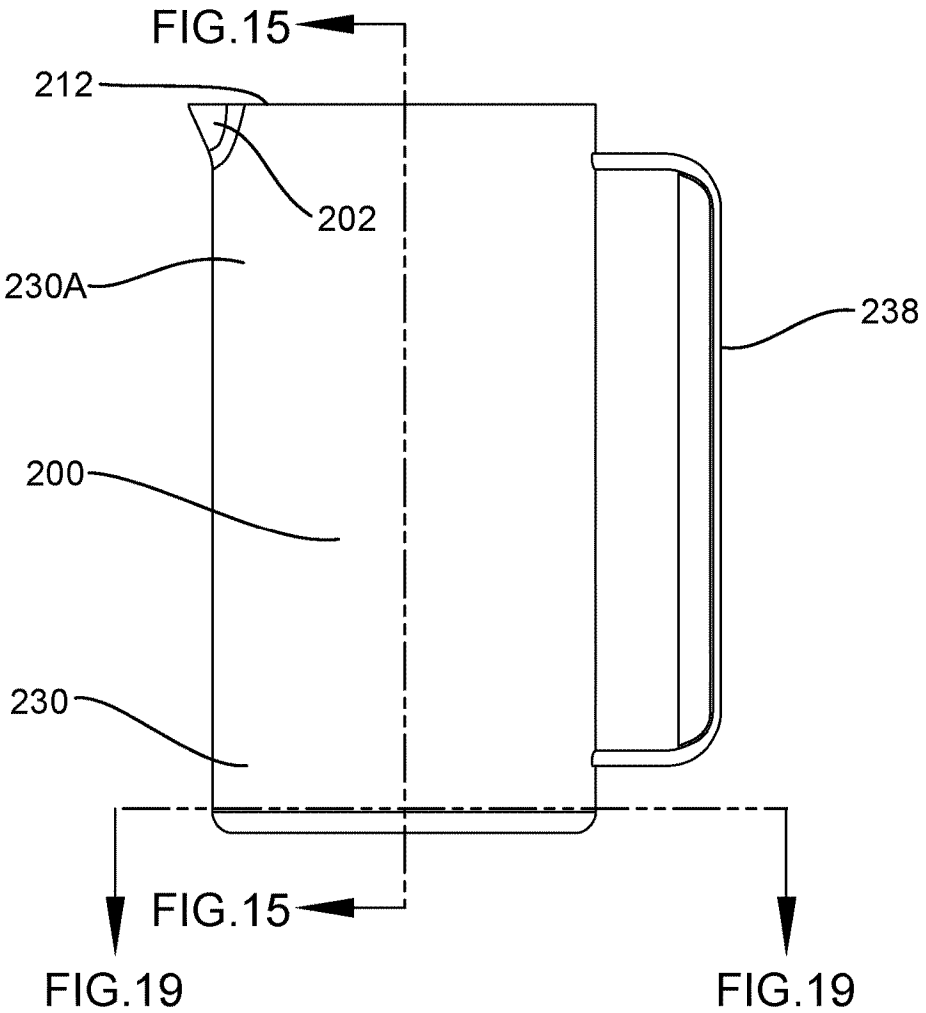
FIG. 13 shows a left-side view of the container of FIG. 12.
Figure 15:
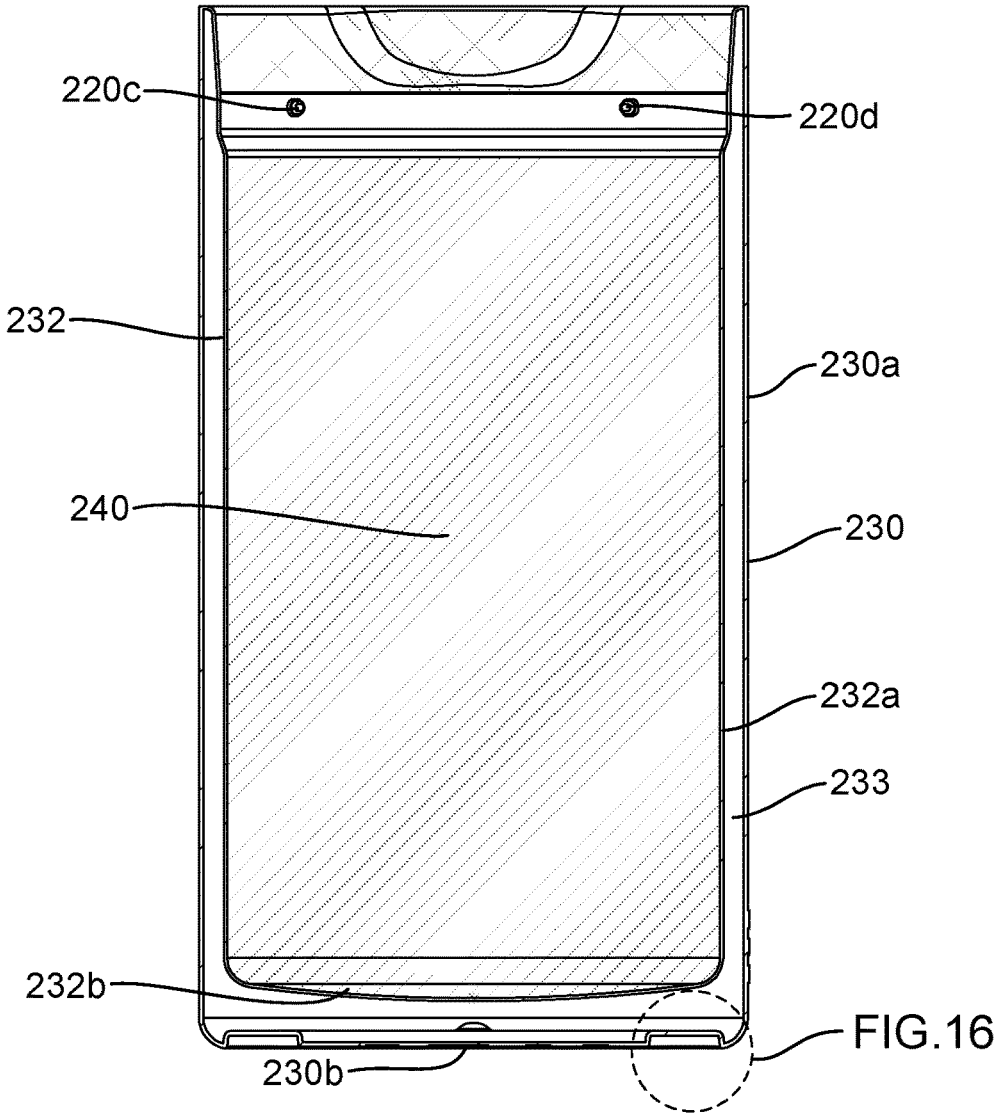
FIG. 15 shows a cross-sectional view along line 15-15 in FIG. 13.
Figure 18:
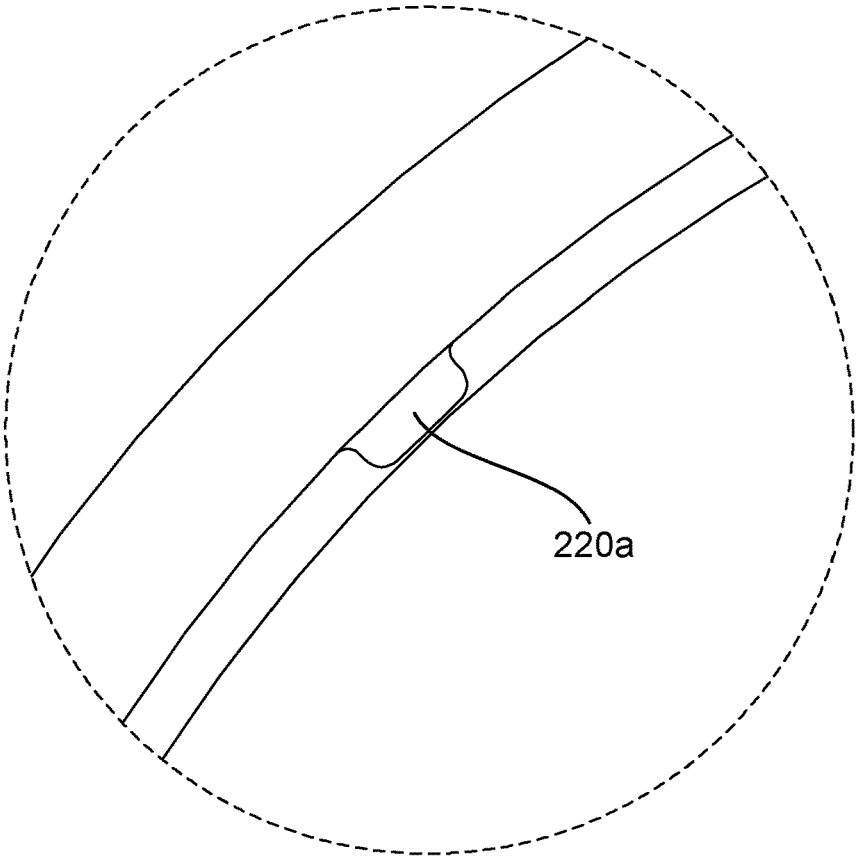
FIG. 18 shows an enlarged section of FIG. 17.

In this example, as discussed above, the insulated container 200 may include a plurality of container projections 220*a*, 220*b*, 220*c*, 220*d* as shown in FIGS. 15, 17, and 18. And the number of the plurality of container projections 220*a*, 220*b*, 220*c*, 220*d* may be four in this example. The plurality of container projections 220*a*, 220*b*, 220*c*, and 220*d* can be positioned radially about the container. As shown in FIGS. 12, 15, and 17, the plurality of projections can be positioned on the inner side wall 232*a* of the insulated container 200.

In one example, the plurality of insulated container projections 220*a*, 220*b*, 220*c*, 220*d* of the insulated container 200 can be oriented asymmetrically about the circumference of the container 200. And in this example, the plurality of insulated container projections 220*a*, 220*b*, 220*c*, 220*d* can be positioned about the lid asymmetrically in the radial direction, meaning that each of the plurality of insulated container projections 220*a*, 220*b*, 220*c*, 220*d* can be positioned at different radial dimensions relative to each other or at a different amount of degrees relative to each other. Also in this example, the plurality of insulated container projections 220*a*, 220*b*, 220*c*, 220*d* can be positioned at the same distance or depth relative to the rim 212 of the insulated container in the axial direction.

In this example, with reference to FIG. 17, which is a top view of the insulated container, the insulated container spout 202 may define a spout central axis 236, and the handle 238 can define a handle central axis, which can be the same central axis 236 as the spout central axis. A first one 220*a* of the plurality insulated container projections may be positioned at a first angle α relative to the container spout central axis 236 and the handle central axis 236. Also a second one of the container plurality of grooves or projections can be positioned at a second angle β relative to the axis. The first angle α can be greater than the second angle β.

In this example, a third one 220*c* of the insulated container plurality of projections can be positioned at a third angle γ relative to the spout central axis 236 and handle central axis 236. Also a fourth one 220*d* of the plurality of container projections may be positioned at a fourth angle δ relative to the handle axis. In this example, the fourth angle δ is smaller than the third angle γ. In addition, the fourth angle δ is smaller than the first angle. In one particular example, the first angle α can be about 44 degrees, the second angle β can be about 20 degrees, the third angle γ can be about 45 degrees, the fourth angle δ can be about 38 degrees. As such, the plurality of container projections 220*a*, 220*b*, 220*c*, 220*d* can each positioned at a different angle relative to an adjacent one of the plurality of container projections 220*a*, 220*b*, 220*c*, 220*d*, and each of the first angle α, the second angle β, the third angle γ, and the fourth angle & can be acute.

Also the sum of the first angle α and the second angle β can be about 64 degrees to form an acute angle between the first one 220*a* and the second one 220*b* of the plurality of projections. Also the sum of the third angle γ and the fourth angle δ can be about 83 degrees to form an acute angle between the third one 220*c* and the fourth one 220*d* of the plurality of projections.

Additionally, a fifth angle θ can be formed between the second container projection and the third container projection 220*c*, and a sixth angle λ can be formed between the fourth container projection 220*d* and the first container projection 220*a*. The fifth angle θ can be about 115 degrees, and the sixth angle λ can be about 98 degrees. As such the fifth angle θ and the sixth angle λ can both be obtuse and greater than 90 degrees. Accordingly, the fifth angle θ between the second one 220*b* and the third one 220*c* of the plurality of projections can be obtuse. And the sixth angle λ between the first one 220*a* and the forth one 220*d* can be obtuse. The first angle α, the second angle β, the third angle γ, the fourth angle δ, fifth angle θ, and the sixth angle λ in relation to the container can correspond to the first angle α, the second angle β, the third angle γ, the fourth angle δ, fifth angle θ, and the sixth angle λ discussed above in relation to the lid assembly.

Figure 19:
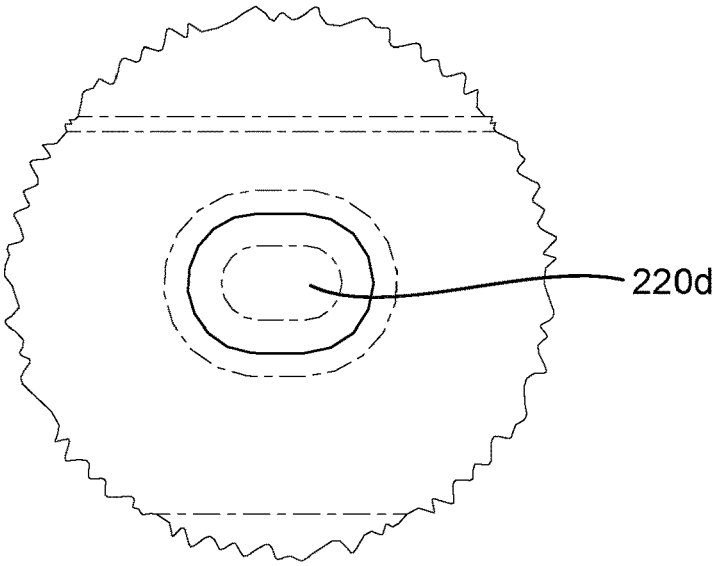
FIG. 19 shows an enlarged section along line 19-19 of FIG. 17.
Figure 20:
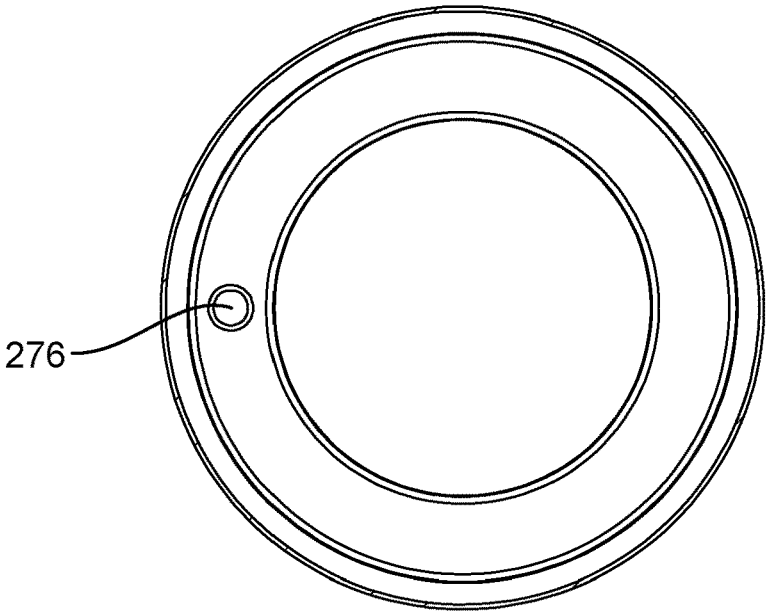
FIG. 20 shows a partial bottom view of the example container of FIG. 12.

As shown in FIG. 18, which is an enlarged view of FIG. 17, each of the plurality of the projections 220*a*, 220*b*, 220*c*, 220*d* extend from the inner wall of the insulated container. Referring to FIG. 19, which is an enlarged cross-section of FIG. 18, the plurality of container projections 220*a*, 220*b*, 220*c*, and 220*d* can each have an oblong shape. And in this example, the plurality of container projections each have a width to length ratio of greater than one. In one particular example, the height of the projections 220*a*, 220*b*, 220*c*, and 220*d* can be about 3 mm and the width of the projections 220*a*, 220*b*, 220*c*, and 220*d* can be about 4 mm.

In alternative examples similar to the lid assembly 100, it is contemplated that the plurality of insulated container projections 220*a*, 220*b*, 220*c*, 220*d* can be substituted with grooves similar to the lid assembly skirt grooves 120*a*, 120*b*, 120*c*, and 120*d* discussed herein. And in another example, again here, the plurality of insulated container projections 220*a*, 220*b*, 220*c*, 220*d* can be a combination of grooves and projections. Moreover, it is contemplated that the plurality of insulated container projections 220*a*, 220*b*, 220*c*, and 220*d* can be positioned symmetrically in the radial direction. Also in other examples, it is contemplated that the plurality of insulated container projections 220*a*, 220*b*, 220*c*, 220*d* can be positioned at different distances or depths relative to the insulated container rim 212 in the axial direction, and the corresponding plurality of skirt grooves 120*a*, 120*b*, 120*c*, and 120*d* be correspondingly positioned to align with the insulated container projections 220*a*, 220*b*, 220*c*, and 220*d* when positioning the lid assembly 100 in the locked position.

The lid assembly may be configured to be placed onto the container in a single orientation due to the asymmetrical plurality of insulated container projections 220*a*, 220*b*,

220*c*, 220*d* and the asymmetrical plurality of skirt grooves 120*a*, 120*b*, 120*c*, 120*d*. An engagement of the plurality of skirt grooves 120*a*, 120*b*, 120*c*, 120*d* with the insulated container projections 220*a*, 220*b*, 220*c*, 220*d* can create a first force and the gasket engaging the inner wall of the insulating container may create a second force and wherein the first force and the second force are configured to help retain the lid assembly onto the insulated container. Also, the slider 108 can be held onto the lid assembly 100 by a first force, and the lid assembly 100 can be held onto the container 200 by a second force and the second force may be greater than the first force. When the lid assembly 100 is in the locked position, the plurality of container projections 220*a*, 220*b*, 220*c*, 220*d* engage the second straight portions 124 of the plurality of skirt grooves 120*a*, 120*b*, 120*c*, and 120*d* in the locked position.

In alternative configurations, it is also contemplated that the lid assembly 100 can be secured to the insulated container assembly 200 using one or more of threads, bayonet connections, hinges, or collars and the like. In another example, a suction buttons or mechanism which pulls air from the contain or expands a gasket can be used to create a seal between the lid assembly 100 and the container assembly 200. It is also contemplated that the lid assembly 100 can be held onto the container assembly 200 using only the friction created between the gasket 130 and the container 200. In this example, the lid assembly 100 can include an outwardly extending tab, which extends from the rim, to provide the user with leverage in order to remove the lid assembly from the container.

Figure 16:
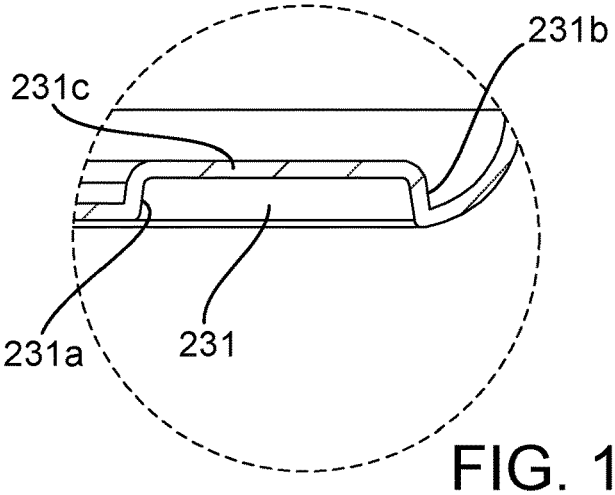
FIG. 16 shows an enlarged section of the cross-sectional view of FIG. 15.
Figure 21:
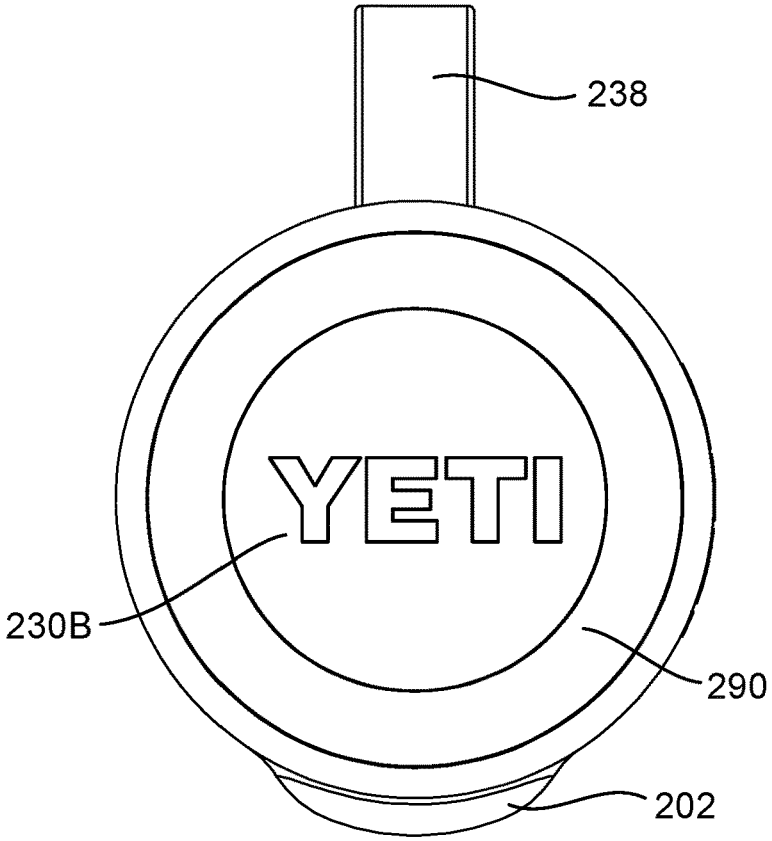
FIG. 21 is a bottom view of the example container of FIG. 12.

As shown in FIG. 21, the container assembly 200 may include a foot member 290 to provide a slip resistant surface to support the container 200. Example foot members are described in U.S. application Ser. No. 17/868,471 filed on Jul. 19, 2022 and U.S. application Ser. No. 16/146,692, filed on Sep. 18, 2018, now U.S. Pat. No. 10,729,261, both of which are fully incorporated by reference herein. The foot member 290 may be attached to the outer bottom wall 230B. As shown in FIGS. 15 and 16, the outer bottom wall 230B may include a lower cavity 231. The lower cavity 231 may include an inner cavity wall 231A, an outer cavity wall 231B, and a bottom cavity wall 231C. The lower cavity 231 may be ring-shaped such that the inner cavity wall 231A and the outer cavity wall 231B each form a continuous loop that are spaced apart from each other.

While the illustrated example includes a ring-shaped lower cavity 231, the lower cavity may have other shapes such as a square, circular, oval, or other geometric shape. In other examples, the lower cavity 231 may comprise a plurality of cavities. Additionally, in examples with multiple lower cavities, each of the lower cavities may include a separate foot member, or a foot member than has a portion that is received in each of the lower cavities.

Figure 16A:
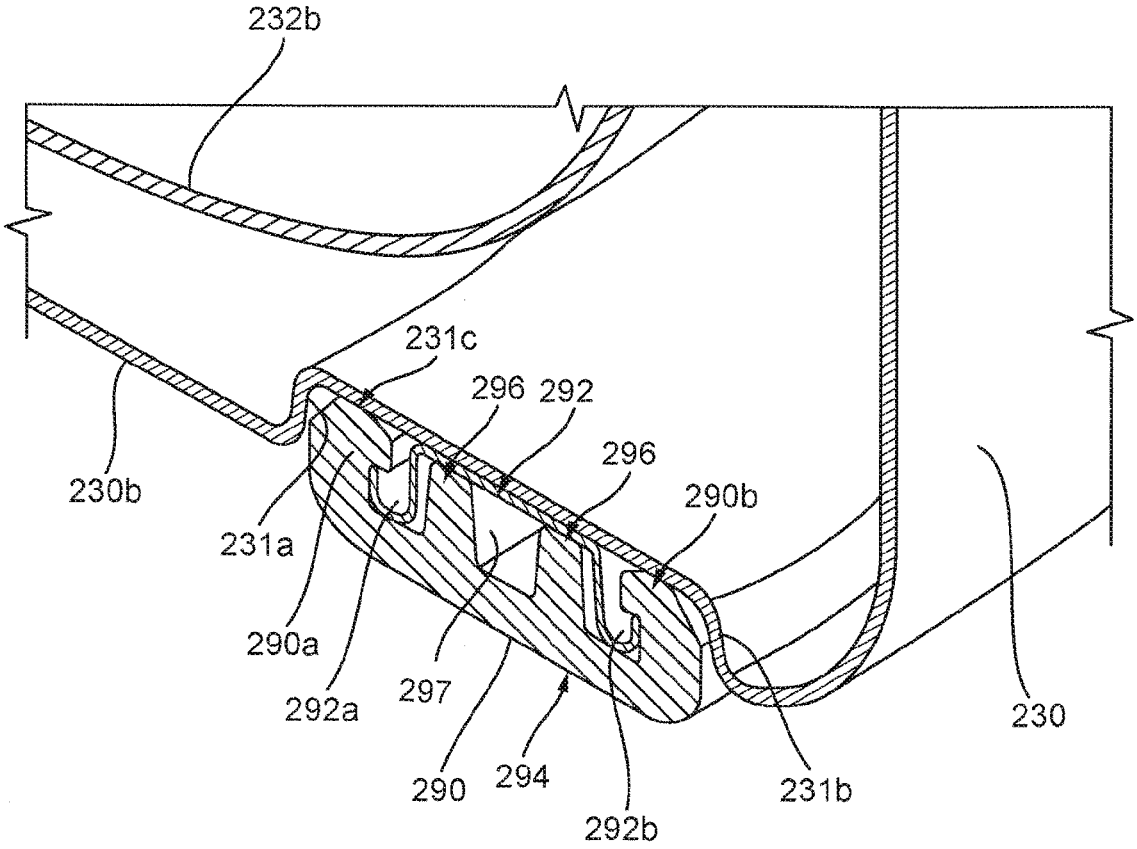
FIG. 16A shows a cross-sectional perspective view of a lower right section of the container of FIG. 11.

In one example, as shown in FIG. 16A, a foot bracket 292 may be located in the lower ring-shaped cavity 231. The foot bracket 292 may be connected to the bottom cavity wall 231C and may include a hook member or a plurality of hook members 292A, 292B located on the foot bracket 292 that engage and secure the elastomeric foot member 290. The plurality of hook members 292 form a snap-fit type of connection with the elastomeric foot member 290. The foot member 290 may be ring-shaped and form a slip resistant surface to support the container 200. In this example, the foot member 290 may be shaped in a manner that is compatible with or mates with the foot bracket 292. For example, the bottom of the foot member 290 may be a flat surface 294. The other side of the foot member 290 may include two curved ends 290A, 290B and double ridges 296 in the middle of the foot separated by a gap 297. Correspondingly, as discussed above the foot bracket 292 may include a plurality of hook members 292A, 292B or two curved ends that mate with the curved ends 290A, 290B of the foot member 290. Further, the foot bracket 292 may include a center gap 297 between the two curved ends of the foot bracket 292. Also shown in FIG. 16A, the double ridge 296 of the foot member 290 is configured to mate with the center gap 297 of the foot bracket 292. In this example, the foot member 290 can be pressed onto the bracket 292 and snap-fit to the container 200 and may be designed to not be removable by the user.

In addition, a divot, dimple or opening 276 used for vacuum formation may be located in the bottom cavity wall 231C. The opening 276 may be a round shaped hole and may be positioned on the handle and spout axis. In the illustrated example, only one opening is present, but multiple openings are contemplated. As discussed below, the opening 276 may assist in evacuating the gas from the cavity formed between the outer and inner shells 230, 232. In addition, the opening 276 may be aligned with a corresponding projection (not show) arranged on a bottom surface of the foot bracket 290.

As discussed above, the opening, divot or dimple structure 276 is used during a vacuum formation process. But the opening, divot or dimple structure 276 can be included anywhere on the outer shell 230 or the inner shell 232. Such dimple structures and formation processes are disclosed and described in U.S. application Ser. No. 16/146,692, filed on Sep. 18, 2018, now U.S. Pat. No. 10,729,261, U.S. Application No. 62/237,419, filed on Oct. 5, 2015, U.S. Application No. 62/255,886 filed on Nov. 16, 2015, and U.S. application Ser. No. 15/285,268, now U.S. Pat. No. 10,390, 659, all of which are incorporated fully herein by reference. In one example, the divot or dimple 276 can resemble a dome shape. However, other suitable shapes are contemplated for receiving a resin material during the manufacturing process. The example container 200 can be provided with one or more vacuum chambers, such as internal cavity 233 shown in FIG. 15, to reduce heat transfer by conduction, convection and/or radiation. To achieve a vacuum between the outer body and inner body of the bowl, the air within the container can be removed by heating the container within the vacuum and removing the air between the outer shell 230 and the inner shell 232 through the opening in the divot or dimple 276 on outer shell 230 and/or inner shell 232.

The divot or dimple 276 can provide a conduit to the internal cavity of the during formation. Specifically, the container 200 can be oriented inverted within a vacuum formation chamber, and a resin, which can be in the shape of a pill, can be placed into the divot or dimple in the bottom of the container during the vacuum forming process. In certain examples, the resin can be approximately 3 mm to 5 mm in diameter, and the openings in the divot or dimple can be approximately 1 mm in size. In this way, when the container 200 is heated the resin becomes viscous so as to not flow or drip into the internal cavity 233 of the container 200 through the opening, but permeable to air such that the air escapes the internal chamber 233 or other internal volume of the container 200. Once the resin cools and solidifies, it covers the opening of the divot or dimple and seals the internal cavity 233 or other internal volumes of the container 200 to form a vacuum within the container 200. Any suitable resins are contemplated for forming the vacuum within the container 200. In certain examples, the resin material can be synthetic, such as an epoxy resin or may be plant based. In this example, after vacuumization, the dimple or divot 276 can be covered by the foot member 290. However, it is also contemplated that the resin can be polished such that the dimple or divot is not readily apparent or noticeable to the user. In still other examples, the dimple or divot may be covered by a cap and polished, in the same manner, such that the cap and dimple or divot are not readily apparent or noticeable to the user.

In addition, various other techniques can be used to cover or seal the dimple, which may include painting the resin, powder coating the dimple, adhering metal or paper over the opening, or adding a rubber or plastic piece to cover the opening, or including a rubber or plastic piece on the bottom. In still other examples, the dimples or divots can be covered or sealed with either a disc or with an end cap (not shown). Welding the disc to the bottom of the container 200 or welding an end cap to the bottom of the outer shell 230 provides a more permanent structure that can be repeatedly used and washed without compromising the structural integrity of the container 200. Covering the divots with the disc may result in a more compact container 200 since an end cap will add to the overall height of the container. This may help in saving costs in manufacturing the container, since less material is needed. Additionally, the container will be able to store more liquid within a smaller container volume and length. Alternatively, the container 200 may be configured with a dimple or divot in the inner shell 232 (not shown) to facilitate the vacuumization process as described herein.

Additional alternate methods of insulating the container 200 are also contemplated. For example, the internal cavity 233 may be filled with various insulating materials that exhibit low thermal conductivity such as foam. As such, the internal cavity 233 may, in certain examples, be filled with air to form air pockets for insulation, or filled with a mass of material such as a polymer material, or a polymer foam material. In one specific example, the internal cavity 233 may be filled with polystyrene. However, additional or alternative insulating materials may be utilized to fill the internal cavity 233 without departing from the scope of these disclosures. In certain examples, the internal cavity 233 is filled with insulating materials by injecting the materials via dimples, divots, or other conduits to the internal cavity 233. In other examples, the insulating materials are added to the internal cavity 233 prior to connecting the inner shell 232 with the outer shell 230. In other examples, the internal cavity 233 may be configured to be partially or wholly filled with an additional insulating material. For example, internal cavity 233 may be configured to be, or may be, at least partially filled with an alternative polymeric foam, such as polystyrene foam, polyvinyl chloride foam, or polyimide foam, among many others.

For the formation of the insulated container, the outer and inner shells 230, 232 may be formed as two separate pieces. The outer and inner shells 230, 232 may have a substantially constant wall thickness. The outer and inner shells 230, 232 may be constructed using one or more sheet-metal deep-drawing and/or stamping processes, and using, in one example, stainless steel sheet-metal. However, it will be readily appreciated that the insulating container 200 may be constructed using one or more additional or alternative metals and/or alloys, one or more fiber-reinforced materials, one or more polymers, or one or more ceramics, or combinations thereof, among others, without departing from the scope of these disclosures. Accordingly, one or both of the outer shell 230 and the inner shell 232 may have wall thicknesses (i.e. may utilize a sheet-metal thickness) ranging at or between 0.2 mm to 4 mm or approximately 0.5 mm, 1 mm, 1.5 mm, 2 mm, 2.5 mm, 3 mm, 4 mm, among others.

In one specific example, the inner shell 232 may be secured to the outer shell 230 by a welding operation utilizing a robotic arm and camera system in conjunction with a stationary electrode or the like to ensure that inner shell 232 is connected along the entire upper edges of the outer shell 230 and the inner shell 232. These coupling processes may integrally join the outer shell 230 and the inner shell 232 and may include one or more brazing or welding processes (including, among others, shielded metal arc, gas tungsten arc, gas metal arc, flux-cored arc, submerged arc, electroslag, ultrasonic, cold pressure, electromagnetic pulse, laser beam, or friction welding processes). In another example, the outer shell 230 may be integrally joined to the inner shell 232 by one or more adhesives, by a sheet metal hem joint, or by one or more fastener elements (e.g. one or more screws, rivets, pins, bolts, or staples, among others).

Once the shells 230, 232 are integrally joined, a mass of gas/air may be evacuated from the cavity formed between the inner and outer shells 230, 232 to create a sealed vacuum cavity 233 between the two shells 230, 232. To achieve a vacuum between the walls of the container 200 (e.g. between the outer sidewall 230 and the inner sidewall 232, and the outer bottom wall 230B and the inner bottom wall 232B), at least a portion of air between the two shells 230, 232 may be removed by positioning the container 200 within a larger chamber (not depicted), and removing at least a portion of the air from the cavity 233 between the shells 230, 232 by pulling a vacuum within the larger chamber (not depicted) (e.g. reducing an internal pressure of the larger chamber to a pressure below an internal pressure within the vacuum cavity 233). It will be appreciated that any techniques and/or processes may be utilized to reduce a pressure within the larger chamber (not depicted), including, vacuum pumping, among others. As such, a portion of air within the vacuum cavity 233 may escape through the dimple or divot 276 located in the bottom cavity wall 231C of the lower cavity 231 located on the outer bottom wall 230B. Again, it is also contemplated that several dimples, divots, or openings be placed on the outer bottom wall 230B. And in one example, the opening 276 may be a round shaped hole. In addition, the openings 276 may be located in the bottom cavity wall 231C and also be aligned with a hole (not shown) arranged in the foot member such that the vacuum may be applied after the foot member 290 is applied to the outer shell 230.

In certain implementations, a pressure within the vacuum cavity 233 of the insulating container 200 may measure less than 15 μTorr. In other examples, the vacuum may measure less than 10 μTorr, less than 50 μTorr, less than 100 μTorr, less than 200 μTorr, less than 400 μTorr, less than 500 μTorr, less than 1000 μTorr, less than 10 mTorr, less than 100 mTorr, or less than 1 Torr, among many others.

In order to seal a vacuum within the vacuum cavity 233, a resin, which may be in the shape of a pill, may be placed into the dimple, divot, or opening 276 during the vacuum forming process. In some examples, the vacuum formation chamber may be heated to a temperature at which the resin may become viscous. In one example, the viscosity of the resin may be such that the resin does not flow or drip into the container through the opening, but is permeable to air such that the air can escapes the internal volumes of the vacuum cavity 233. In one implementation, a vacuum forming process may heat the insulating container 200 to temperature of approximately 550° C. In other implementations, during the vacuum forming process the insulating container may be heated to approximately 200° C., 250° C., 300° C., 350° C., 400° C., 450° C., 500° C., or 600° C., among others. Following a period of heating, the insulating container 200 may be passively or actively cooled to room temperature. As such, once the resin cools and solidifies, it covers the dimple, divot, or opening 276, and seals the internal volume of the container 200 to form a vacuum cavity 233 between the outer shell 230 and the inner shell 232.

Lastly, the foot member 290 may be installed onto a foot bracket (not shown). The foot member 290 may be secured with a press fit or friction fit onto the hook members (not shown) of the foot bracket (not shown). The foot member 290 may be formed from an elastomeric material to help increase the friction and help prevent the container 200 from sliding when placed on a flat surface.

Aspects of the disclosure include an insulated container assembly which can include an insulated container and a lid assembly. The insulated container can include an outer shell comprising an external sidewall and an outer bottom wall, an inner shell having an inner sidewall and an inner bottom wall. The outer shell may be connected to the inner shell forming an insulated double wall structure with a sealed vacuum cavity between the outer shell and the inner shell. The insulated container can include a top opening at a top of the inner sidewall that leads into a storage cavity formed by the inner sidewall and the inner bottom wall. The top opening may include a container pour spout. The insulated container can include one of a plurality of container projections or grooves.

The lid assembly may include a lid assembly pour spout corresponding to the container pour spout, and one of a plurality of lid assembly grooves or projections, corresponding to the plurality of container grooves or projections of the insulated container. The lid assembly may be configured to lock in place on the container by engaging the plurality of lid assembly grooves or projections with the container grooves or projections when in the locked position.

In one example, the plurality of container grooves or projections of the insulated container may be asymmetrically positioned and the plurality of lid assembly grooves or projections can be asymmetrically positioned.

The lid assembly may be configured to be placed onto the container in a single orientation due to the asymmetrical plurality of container grooves or projections and the asymmetrical plurality of lid assembly grooves or projections.

The container spout can define a spout central axis and a first one of the plurality of grooves or projections is positioned at a first angle relative to the axis and a second one of the container plurality of grooves or projections is positioned at a second angle relative to the axis and wherein the first angle is greater than the second angle.

The insulated container may include a handle, and the handle can define a handle central axis and a third one of the insulated container plurality of grooves or projections is positioned at a third angle relative to the handle axis and a fourth one of the plurality of container grooves or projections can be positioned at a fourth angle relative to the handle axis and the third angle can be larger than the fourth angle.

The plurality of container grooves or projections can be positioned radially about the container and the plurality of container grooves or projections can include a first container groove or projection, a second container groove or projection, a third container groove or projection, and a fourth container groove or projection and a first angle between the first container groove or projection and the second container groove or projection is obtuse, a second angle between the second container groove or projection and the third container groove or projection can be acute, a third angle between the third container groove or projection and the fourth container groove or projection can be obtuse, a fourth angle between fourth container groove or projection and the first container groove or projection can be acute. In one arrangement, the fourth angle can be smaller than the first angle.

The plurality of container grooves or projections can be each positioned at a different angle relative to an adjacent one of the plurality of container grooves or projections. The number of the plurality of container grooves or projections can be four.

The plurality of skirt grooves or projections can include a plurality of skirt grooves and the plurality of skirt grooves can extend in a radial direction and an axial direction and the plurality of container grooves or projections can include a plurality of container projections. The plurality of skirt grooves can each have a first straight portion extending in a radial and axial direction and a second straight portion extending only in a radial direction and wherein the container projections engage the second straight portion in the locked position. The first straight portion and the second straight portion can extend for a total of about between 45 to 180 degrees in the radial direction. The first straight portion may be oriented about 45 degrees relative to a rim of the insulated container when the lid assembly is assembled to the insulated container and the second straight portion can be generally parallel to a rim of the insulated container when assembled and the first straight portion can be longer than the second straight portion.

The plurality of container projections or the plurality of skirt projections can each have an oblong shape and the plurality of container projections or the plurality of skirt projections can each have a width to length ratio of greater than 1.

The container can further include a radially extending channel about a top portion of the skirt and a gasket can be positioned in the radially extending channel and the plurality of skirt grooves or projections can be positioned below the gasket.

An engagement of the plurality of skirt grooves or projections with the container grooves or projections may create a first force in an axial direction and the gasket engaging the inner wall of the insulating container can create a second force in the axial direction. The first force and the second force may be configured to help retain the lid assembly onto the container when the user dispenses the contents of the insulated container.

In another aspect, an insulated container assembly can include an insulated container which may include an outer shell having an external sidewall and an outer bottom wall: an inner shell having an inner sidewall and an inner bottom wall. The outer shell may be connected to the inner shell forming an insulated double wall structure with a sealed vacuum cavity between the outer shell and the inner shell. The insulated container can include a top opening at a top of the inner sidewall that leads into a storage cavity formed by the inner sidewall and the inner bottom wall, and the top opening can include a container pour spout. The insulated container may include one of a plurality of container projections or grooves.

In another aspect, the lid assembly can include a lid assembly pour spout corresponding to the container pour spout. The lid assembly can include a top surface having a top surface channel for receiving a slider, and an opening adjacent the lid assembly pour spout. The slider may be configured to move from an opened position to a closed position to cover the opening. The lid assembly may include a rim and a skirt extending axially from the rim. The skirt may include one of a plurality of skirt grooves or projections, corresponding to the plurality of container grooves or projections of the insulated container. And the lid assembly can be configured to lock in place on the container by engaging the plurality of skirt grooves or projections with the container grooves or projections when in the locked position. In one example, the slider is held onto the lid assembly by a first force, the lid assembly is held onto the container by a second force and the second force can be greater than the first force.

The plurality of insulated container grooves or projections of the insulated container can be asymmetrical and the plurality of skirt grooves or projections are asymmetrical. The plurality of container grooves or projections can each positioned at a different angle relative to an adjacent one of the plurality of container grooves or projections. The skirt can include a plurality of grooves, and the container can include a plurality of projections. In one example, the plurality of grooves can extend entirely through a sidewall forming the skirt. The plurality of projections can be positioned on the inner wall of the container.

In another aspect, a lid assembly may include a lid assembly pour spout, one of a plurality of lid assembly grooves or projections. And the lid assembly can be configured to lock in place on a container by engaging the plurality of lid assembly grooves or projections with container grooves or projections when in the locked position. The plurality of lid assembly grooves or projections can be asymmetrically positioned and the plurality of skirt grooves or projections can be asymmetrically positioned. The plurality of lid assembly grooves or projections can each be positioned at a different angle relative to an adjacent one of the plurality of lid assembly grooves or projections. The plurality of lid assembly grooves or projections can include a plurality of lid assembly grooves, and the plurality of lid assembly grooves can each have a first straight portion extending in a radial and axial direction and a second straight portion extending only in a radial direction. The container projections may engage the second straight portion in the locked position. The lid assembly can include gripping elements for the user to rotate the lid assembly relative to the insulated container.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

What is claimed is:

1. An insulated container assembly comprising:

an insulated container comprising:

an outer shell comprising an external sidewall and an outer bottom wall;

an inner shell comprising an inner sidewall and an inner bottom wall;

the outer shell connected to the inner shell forming an insulated double wall structure with a sealed vacuum cavity between the outer shell and the inner shell;

the insulated container having a top opening at a top of the inner sidewall that leads into a storage cavity formed by the inner sidewall and the inner bottom wall, the top opening comprising a container pour spout, wherein the container pour spout defines a container pour spout central axis extending in a central plane of the insulated container, the central plane of the insulated container extending perpendicular to a bottom surface of the outer bottom wall;

the insulated container comprising one of a plurality of container grooves or projections;

a lid assembly comprising:

a lid assembly pour spout corresponding to the container pour spout wherein the lid assembly pour spout defines a lid assembly pour spout central axis extending in a central plane of the lid assembly, the central plane of the lid assembly extending perpendicular to a top surface of a rim of the lid assembly; and one of a plurality of lid assembly grooves or projections, corresponding to the plurality of container grooves or projections of the insulated container;

wherein the lid assembly is configured to lock in place by twisting the lid assembly onto the insulated container by engaging the plurality of lid assembly grooves or projections with the plurality of container grooves or projections and wherein the lid assembly is configured to move radially and axially relative to the insulated container when twisting the lid assembly onto the insulated container;

wherein the plurality of container grooves or projections of the insulated container are asymmetrically positioned about the central plane of the insulated container and the plurality of lid assembly grooves or projections are asymmetrically positioned about the central plane of the lid assembly.

2. The insulated container of claim 1 wherein the lid assembly is configured to be placed onto the container in a single orientation due to the asymmetrical plurality of container grooves or projections and the asymmetrical plurality of lid assembly grooves or projections.

3. The insulated container assembly of claim 1, wherein a first one of the plurality of container grooves or projections is positioned at a first angle relative to the container pour spout central axis and a second one of the plurality of container grooves or projections is positioned at a second angle relative to the container pour spout central axis and wherein the first angle is greater than the second angle.

4. The insulated container assembly of claim 2 wherein the insulated container further comprises a handle and wherein the handle defines a handle central axis and wherein a third one of the plurality of container grooves or projections is positioned at a third angle relative to the handle central axis and a fourth one of the plurality of container grooves or projections is positioned at a fourth angle relative to the handle central axis and wherein the third angle is larger than the fourth angle.

5. The insulated container assembly of claim 1, wherein the plurality of container grooves or projections are positioned radially about the container and wherein the plurality of container grooves or projections comprise a first container groove or projection, a second container groove or projection, a third container groove or projection, and a fourth container groove or projection and wherein a first angle between the first container groove or projection and the second container groove or projection is obtuse, wherein a second angle between the second container groove or projection and the third container groove or projection is acute, wherein a third angle between the third container groove or projection and the fourth container groove or projection is obtuse, wherein a fourth angle between fourth container groove or projection and the first container groove or projection is acute.

6. The insulated container of claim 1 wherein the plurality of container grooves or projections are each positioned at a different angle relative to an adjacent one of the plurality of container grooves or projections.

7. The insulated container assembly of claim 1 wherein the plurality of lid assembly grooves or projections comprise a plurality of lid assembly grooves and the plurality of lid assembly grooves extend in a radial direction and an axial direction on the lid assembly and the plurality of container grooves or projections comprise a plurality of container projections.

8. The insulated container assembly of claim 7 wherein the plurality of lid assembly grooves each has a first straight portion extending in a radial and axial direction and a second straight portion extending only in a radial direction and wherein each second straight portion engages a corresponding one of the plurality of container projections in a locked position.

9. The insulated container assembly of claim 8 wherein the first straight portion and the second straight portion extend for a total of about between 45 to 180 degrees in the radial direction.

10. The insulated container assembly of claim 8 wherein the first straight portion is oriented about 45 degrees relative to a rim of the insulated container when the lid assembly is assembled to the insulated container and the second straight portion is generally parallel to the rim of the insulated container when assembled and wherein the first straight portion is longer than the second straight portion.

11. The insulated container assembly of claim 1 wherein the plurality of container projections or the plurality of lid assembly projections each have an oblong shape and wherein the plurality of container projections or the plurality of lid assembly projections each have a width to length ratio of greater than 1.

12. The insulated container assembly of claim 1 further comprising a radially extending channel about a top portion of the lid assembly and wherein a gasket is positioned in the radially extending channel and wherein the plurality of lid assembly grooves or projections are positioned below the gasket.

13. The insulated container assembly of claim 12 wherein an engagement of the plurality of lid assembly grooves or projections with the plurality of container grooves or projections creates a first force in an axial direction and the gasket engaging the inner sidewall of the insulating container creates a second force in the axial direction and wherein the first force and the second force are configured to help retain the lid assembly onto the container assembly when a user dispenses contents of the insulated container.

14. An insulated container assembly comprising:

an insulated container comprising:

an outer shell comprising an external sidewall and an outer bottom wall;

an inner shell comprising an inner sidewall and an inner bottom wall;

the outer shell connected to the inner shell forming an insulated double wall structure with a sealed vacuum cavity between the outer shell and the inner shell;

the insulated container having a top opening at a top of the inner sidewall that leads into a storage cavity formed by the inner sidewall and the inner bottom wall, the top opening comprising a container pour spout the container pour spout defines a container pour spout central axis extending in a central plane of the insulated container, the central plane of the insulated container extending perpendicular to a bottom surface of the outer bottom wall;

the insulated container comprising one of a plurality of container grooves or projections;

a lid assembly comprising:

a lid assembly pour spout corresponding to the container pour spout, wherein the lid assembly pour spout defines a lid assembly pour spout central axis extending in a central plane of the lid assembly;

a top surface comprising a top surface channel for receiving a slider, an opening adjacent the lid assembly pour spout; wherein the slider is configured to move from an opened position to a closed position to cover the opening; and a rim, the central plane of the lid assembly extending perpendicular to a top surface of the rim, a skirt extending axially from the rim, comprising one of a plurality of skirt grooves or projections, corresponding to the plurality of container grooves or projections of the insulated container;

wherein the lid assembly is configured to lock in place on the container by twisting the lid assembly onto the insulated container and engaging the plurality of skirt grooves or projections with the plurality of container grooves or projections;

wherein the plurality of container grooves or projections of the insulated container are asymmetrically positioned about the central plane of the insulated container and the plurality of skirt grooves or projections are asymmetrically positioned about the central plane of the lid assembly.

15. The insulated container of claim 14 wherein the plurality of container grooves or projections are each positioned at a different angle relative to an adjacent one of the plurality of container grooves or projections.

* * * * *